US006356643B2

(12) United States Patent
Yamagishi et al.

(10) Patent No.: US 6,356,643 B2
(45) Date of Patent: Mar. 12, 2002

(54) ELECTRO-ACOUSTIC TRANSDUCER

(75) Inventors: Makoto Yamagishi, Tokyo; Masao Fujihira, Kanagawa, both of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/236,867

(22) Filed: Jan. 26, 1999

(30) Foreign Application Priority Data

Jan. 30, 1998 (JP) ..... 10-019961

(51) Int. Cl.[7] ..... H04R 25/00

(52) U.S. Cl. ..... 381/349; 381/346; 381/348; 381/353; 181/148; 181/155; 181/193

(58) Field of Search ..... 381/349, 336, 381/345, 346, 348, 353, 354, 160; 181/148, 155, 189, 193, 196, 198

(56) References Cited

U.S. PATENT DOCUMENTS

| | | | | |
|---|---|---|---|---|
| 3,938,617 A | | 2/1976 | Forbes | 181/155 |
| 5,119,429 A | * | 6/1992 | Chatelain | 381/348 |
| 5,361,380 A | * | 11/1994 | You et al. | 381/349 |
| 5,373,564 A | * | 12/1994 | Spear et al. | 381/459 |
| 5,432,860 A | * | 7/1995 | Kasajima et al. | 381/459 |
| 5,436,977 A | * | 7/1995 | Sato | 381/349 |
| 5,751,827 A | * | 5/1998 | Takahashi | 381/156 |

FOREIGN PATENT DOCUMENTS

| | | | |
|---|---|---|---|
| EP | 0613317 A1 | 8/1994 | H04R/1/28 |
| GB | 337264 | 10/1930 | |
| GB | 656732 | 8/1951 | |
| GB | 988456 | 4/1965 | |
| GB | 2290672 A | 1/1996 | H04R/1/28 |

* cited by examiner

*Primary Examiner*—Curtis Kuntz
*Assistant Examiner*—Suhan Ni
(74) *Attorney, Agent, or Firm*—Jay H. Maioli

(57) ABSTRACT

An electro-acoustic transducer, such as a speaker device or an earphone device. Includes an electro-acoustic transducing unit, such as a speaker unit, for converting input electrical signals into sound, a casing in which the electro-acoustic transducing unit is arranged and which delimits a back cavity towards the rear side of the electro-acoustic transducing unit, and at least two openings having a sound duct communicating with the back cavity. The sound radiated from the back surface of the electro-acoustic transducing unit is attenuated by being transmitted into the inside of the sound duct to prevent the radiated sound from being re-admitted into the electro-acoustic transducer.

14 Claims, 23 Drawing Sheets

ELECTRO-ACOUSTIC TRANSDUCER

BACKGROUND OF THE INVENTION

1. Field of the Invention

This invention relates to an electro-acoustic transducer for converting electrical signals from, for example, a speaker, or collecting the sound from outside to convert it into electrical signals, in which the effect of the sound radiated to the back side of an electro-acoustic transducing device, such as a speaker unit, is eliminated to improve the acoustic characteristics from the mid to high ranges.

2. Description of the Related Art

As a speaker device, there has hitherto been known a bass-reflex type speaker device 50, shown in FIG. 23*a*, or an enclosure type speaker device 60, as shown in FIG. 23*b*.

The bass-reflex type speaker device 50 has a duct 51 on the front side of a casing 53, as shown in FIG. 23*a*. The enclosure type speaker device 60, on the other hand, is of a hermetically sealed structure, without being formed with an opening, such as a duct, in a casing 63, as shown in FIG. 23*b*.

The bass-reflex type speaker device 50 has sound pressure versus frequency characteristics A, impedance versus frequency characteristics B and second harmonics distortion versus frequency characteristics C, as shown for example in FIG. 24. It may be seen from the sound pressure versus frequency characteristics A in FIG. 24 that the sound pressure is decreased and increased in the low range and in the mid to high range, respectively. Correspondingly, the second harmonics distortion versus frequency characteristics C are increased in the low frequency range, while being lower in the mid to high range than in the low range.

The enclosure type speaker device 60 has sound pressure versus frequency characteristics A, impedance versus frequency characteristics B and second harmonics distortion versus frequency characteristics C, as shown for example in FIG. 25. It may be seen from the sound pressure versus frequency characteristics A in FIG. 25 that, as in the bass-reflex type, described above, the sound pressure is decreased and increased in the low range and in the mid to high range, respectively. Correspondingly, the second harmonics distortion versus frequency characteristics C are increased in the low frequency range, while being lower in the mid to high range than in the low range.

In the above speaker devices 50, 60, when the sound is radiated by diaphragms of speaker units 52, 62 towards the front side, the sound is radiated towards the back side of the speaker unit as well. In these speaker devices 50, 60, the radiated sound is reflected by the inner wall sections of the casings 53, 63 to return back to the diaphragms so as to be superimposed as noise components on the sound radiated from the diaphragms to deteriorate the acoustic characteristics.

In particular, in a speaker device having enclosure in the shape of a cube or parallelepiped, there are produced standing waves between inner wall sections facing the speaker unit. Moreover, significant noise components are superimposed on the sound radiated from the diaphragm.

OBJECTS AND SUMMARY OF THE INVENTION

It is an object of the present invention to provide a novel electro-acoustic transducer which is able to resolve the problems inherent in the conventional electro-acoustic transducer.

It is another object of the present invention to provide a novel electro-acoustic transducer having optimum acoustic characteristics free from adverse effects of the sound radiated from a diaphragm.

It is yet another object of the present invention to provide a novel electro-acoustic transducer having optimum acoustic characteristics free from adverse effects of the sound radiated from the back side of the diaphragm towards the inner side of the casing.

For accomplishing the above objects, the present invention provides an electro-acoustic transducer, such as a speaker device or an earphone device. The transducer includes an electro-acoustic transducing unit, such as a speaker unit, for converting input electrical signals into the sound, a casing in which the electro-acoustic transducing unit is arranged and which delimits a back cavity towards the rear side of the electro-acoustic transducing unit, and at least two openings having a sound duct communicating with the back cavity. The sound radiated from the back surface of the electro-acoustic transducing unit is transmitted into the inside of the sound duct thereof to prevent the sound from being again admitted into the inside of the electro-acoustic transducer.

The present invention also provides an electro-acoustic transducer including electro-acoustic transducing means for converting input electrical signals into sound, a casing in which the electro-acoustic transducing means is arranged and which delimits a back cavity towards the rear side of the electro-acoustic transducing means, and a plurality of sound ducts, with the sound ducts having respective one ends communicating with the back cavity and also having respective opposite ends communicating with one another. The sound radiated from the back surface of the electro-acoustic transducing means is transmitted into the inside of the sound duct thereof to prevent the sound radiated from the back side of the electro-acoustic transducing means from being again admitted into the electro-acoustic transducer.

The present invention also provides an acoustic-electrical transducer including acoustic-electrical transducing means for converting an input sound into electrical signals, and a sound duct having at least two openings and adapted for communicating with the rear side of the acoustic-electrical transducing means. The sound duct transmits to the sound radiated from the rear side of the acoustic-electrical transducing means into the sound duct for attenuation to prevent the sound radiated from the back side of the electro-acoustic transducing means from being again admitted into the electro-acoustic transducer.

Other objects and advantages of the present invention will become apparent from the following description of the present embodiments of the invention in conjunction with the drawings.

DETAILED DESCRIPTION OF THE PREFERRED EMBODIMENTS

Figure 1A:
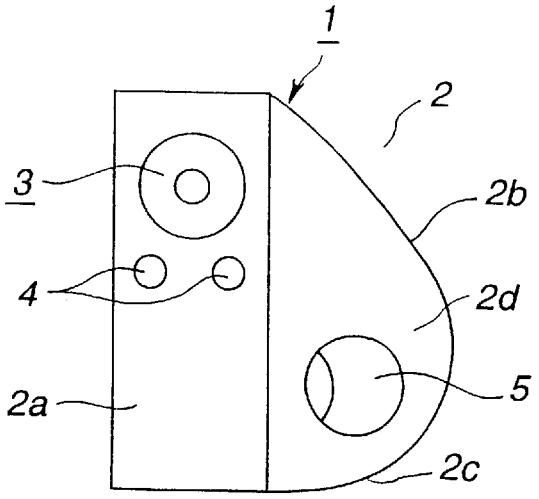
FIG. 1*a* is a perspective view showing a bass-reflex type speaker device according to the present invention.

Referring to the drawings, preferred embodiments of an electro-acoustic transducer and an acoustic-electrical transducer of the present invention will be explained in detail.

Figure 1B:
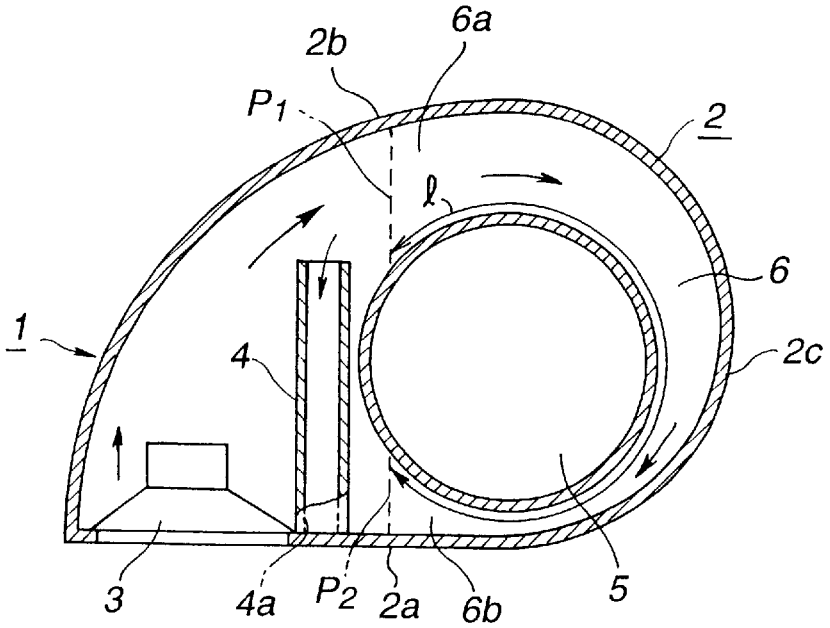
FIG. 1*b* is a cross-sectional view thereof and FIG. 1*c* is a front view thereof.
Figure 1C:
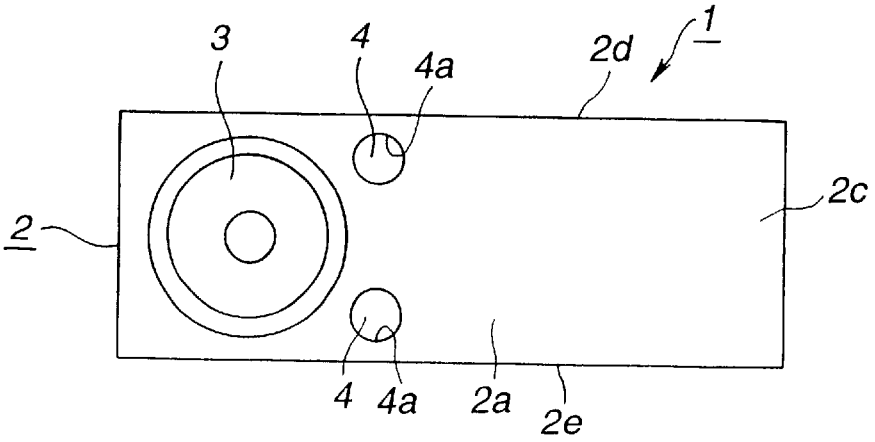

Referring first to FIGS. 1*a* to 1*c*, a speaker device 1 has a casing 2, a speaker unit 3, arranged towards a front wall section 2*a* of the casing 2 and a duct 4 having its openings 4*a* opening in the front wall section 2*a* of the casing 2.

By the speaker unit 3 being fitted to the front wall section 2*a* of the casing 2, the casing 2 constitutes a back cavity of the sound radiated from the back side of the speaker unit 3.

The casing 2 has a planar surface on its front wall section 2*a* and an elliptically curved surface extending from a rear wall section 2*b* towards its front wall section 2*a*. The casing 2 is provided with a cylindrically-shaped member 5 having open ends across both sidewall sections 2*d*, 2*e*. This cylindrically-shaped member 5 is provided at an offset portion towards a bottom wall section 2*c* in a region from the rear wall section 2*b* as far as the bottom wall section 2*c* for delimiting a sound duct 6 within the casing 2, as shown in FIG. 1*b*. This sound duct 6 is formed arcuately for communicating from the elliptically-shaped rear wall section 2*b* of the casing 2 through the bottom wall section 2*c* as far as the front wall section 2*a*.

Meanwhile, since the casing 5 is mounted at an offset position relative to the elliptically-shaped portion extending from the r2*b* to the b2*c* of the casing 2, that is at an offset position from the bottom wall section 2*c* towards the front wall section 2*a* of the casing 2, as shown in FIG. 1*b*, the opening area of an opening 6*b* of the sound duct 6 lying towards the front wall section 2*a* of the casing 2 is smaller than the opening area of an opening 6*a* thereof facing the back side of the speaker unit 3. That is, the cylindrically-shaped member 5 extending for traversing the casing 2 is provided at an offset position with respect to the elliptically-shaped area from the bottom wall section 2*c* towards the front wall section 2*a* of the casing 2, whereby the sound duct 6 is gradually reduced in its opening area in a direction proceeding from the opening side 6*a* towards the opposite side opening side 6*b*.

Meanwhile, the portion indicated by broken lines P1 and P2 in FIG. 1*b* represent the opening ends of the opening side 6*b* and the opposite side opening side 6*b*, respectively.

The speaker unit 3 is provided on the front wall section 2*a* of the casing 2. As electrical signals are fed to the speaker unit 3, its diaphragm is driven to radiate the sound. At this time, the speaker unit 3 radiates the sound towards the front side of the casing 2, while also radiating the sound towards the back side. The sound radiated towards the back side of the speaker unit 3 operates for varying the pressure within the casing 2. The structure of the speaker unit 3 will be explained subsequently in detail.

The duct 4 provided in the casing 2 has its opening 4*a* opening in the front wall section 2*a* of the casing 2. This duct 4 is shaped to exhibit a predetermined resonant frequency to improve the acoustic characteristics in the low range of the sound radiated from the speaker unit 3.

In the speaker device 1, shown in FIGS. 1*a*, 1*b*, and 1*c*, the diameter of the speaker unit 3 is approximately 57 mm, the lowest resonant frequency is approximately 130 Hz, the equivalent mass of the vibrating system is approximately 1.2 g, and the effective radius of the diaphragm provided in the speaker unit 3 is approximately 2.15 cm, with the resonance sharpness Q at the minimum resonant frequency being approximately 0.6. The content of the casing 2 is approximately 630 cc with the inner diameter and the length of the duct 4 being approximately 10 mm and approximately 60 mm, respectively.

If the speaker unit 3 is driven and the diaphragm is set into vibrations, the sound is radiated from both the front and rear sides of the speaker unit 3. The sound radiated towards the rear side of the speaker unit 3 is transmitted through the internal space of the casing 2. The sound radiated from the rear side of the speaker unit 3 is reflected by the rear wall section 2*b* of the casing 2 to enter the sound duct 6 via the opening 6*a* with the larger opening area. The sound then is transmitted towards the opposite side opening 6*b* as it is repeatedly reflected inside the sound duct 6.

If the wavelength of the sound radiated from the speaker unit 3 is longer than the length 1 of the sound duct 6, the sound is not affected by the sound duct 6. However, if the wavelength of the sound radiated from the speaker unit 3 is shorter than the length 1 of the sound duct 6, the sound is repeatedly reflected in the sound duct 6.

The sound duct 6 provided in the speaker device 1 shown in FIG. 1*b* faces the rear side of the speaker unit 3, and is formed so as to be reduced gradually in diameter towards the opening 6*b* from the opening 6*a* with the larger opening area, into which is incident the sound radiated from the back side of the speaker unit 3, as shown in FIG. 1*b*. Therefore, the sound incident on the sound duct 6 is gradually attenuated as it is repeatedly reflected therein and is transmitted in this state from the opening 6*a* towards the other opening 6*b*.

With the speaker device 1 of the present invention, the sound radiated from the rear side of the speaker unit 3 is repeatedly reflected within the sound duct 6 and attenuated to suppress adverse effects on the speaker unit 3. Thus, with the speaker device 1 of the present invention, the sound radiated into the inside of the casing 2 constituting the back cavity from the back side of the speaker unit 3 can be prevented from being repeatedly reflected in the inside of the casing 2 to generate the standing wave, so that the sound can be positively prevented from being re-admitted into the speaker unit 3 to affect the driving of the diaphragm of the speaker unit 3.

Figure 2:
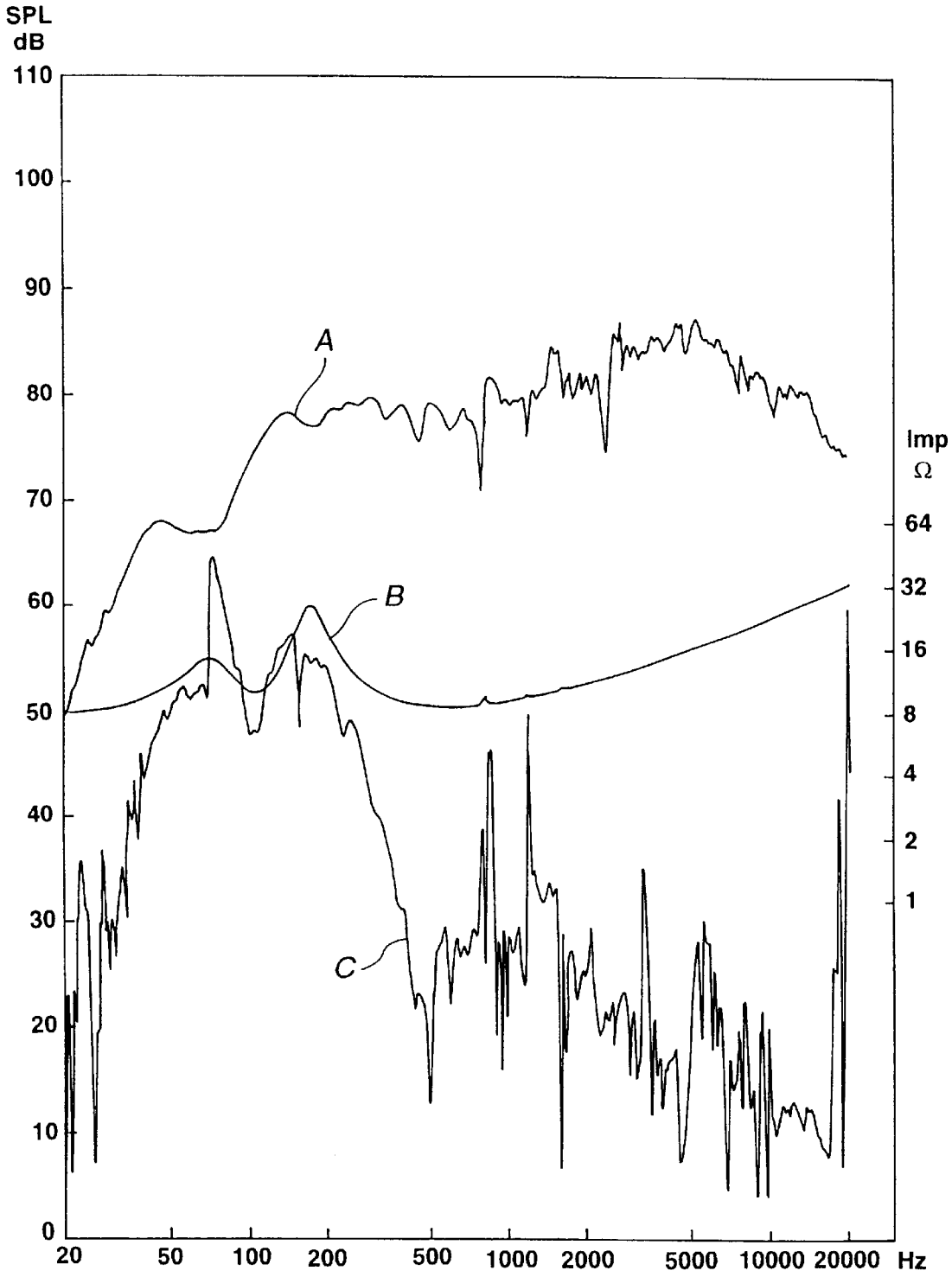
FIG. 2 is a graph showing the relation between the sound pressure, impedance and the secondary harmonics of the speaker device shown in FIG. 1 on one hand and the frequency on the other hand.

The sound pressure versus frequency characteristics A, impedance versus frequency characteristics B and the second harmonics distortion versus frequency characteristics C of the above-described speaker device 1 are shown in FIG. 2, in which the ordinate denotes the sound pressure, distortion in the second harmonics and the impedance, while the abscissa denotes the frequency.

Figure 24:
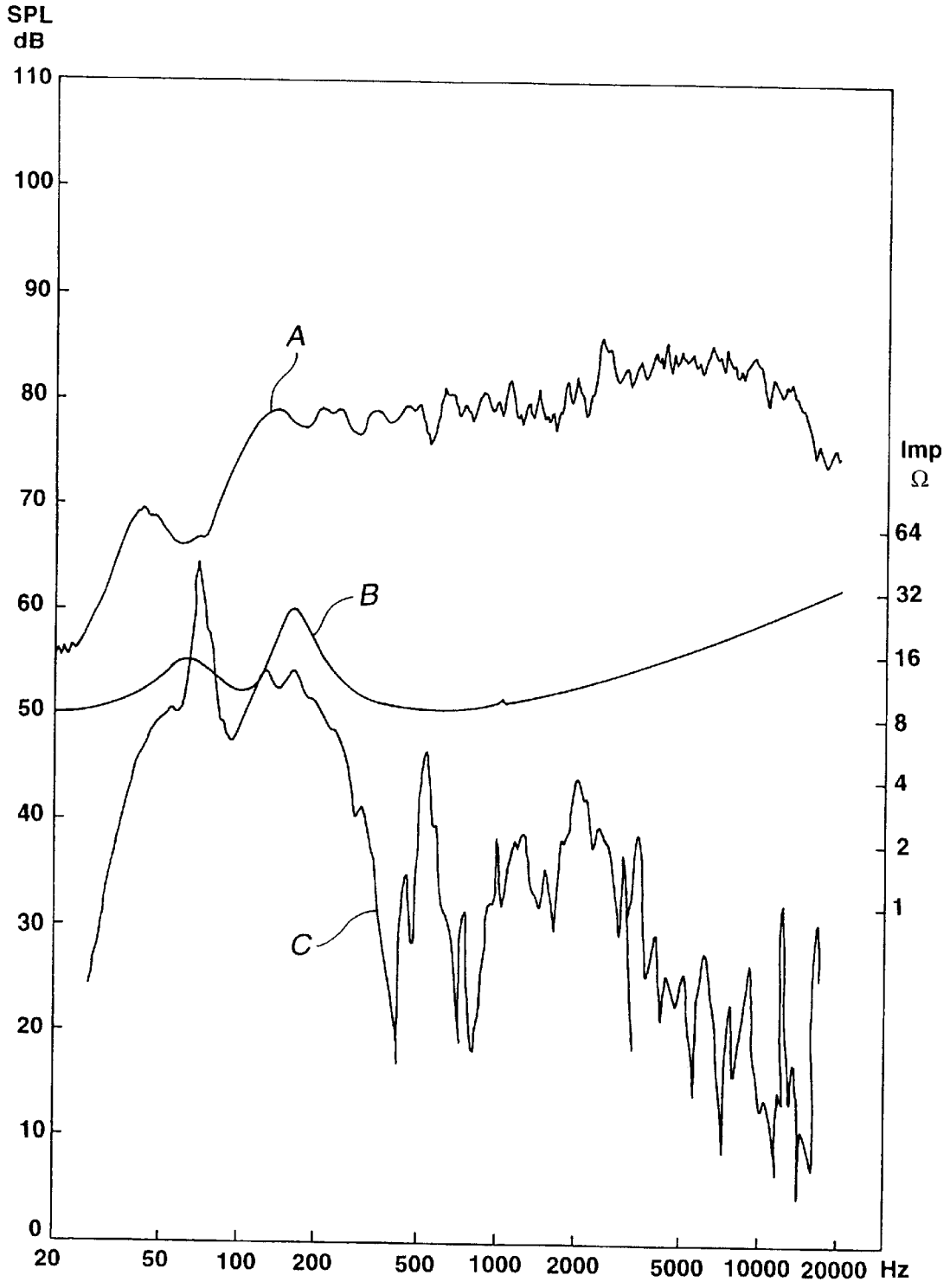
FIG. 24 is a graph showing sound pressure versus frequency characteristics A, impedance versus frequency characteristics B and second harmonics distortion versus frequency characteristics C of a conventional bass-reflex type speaker device.
Figure 25:
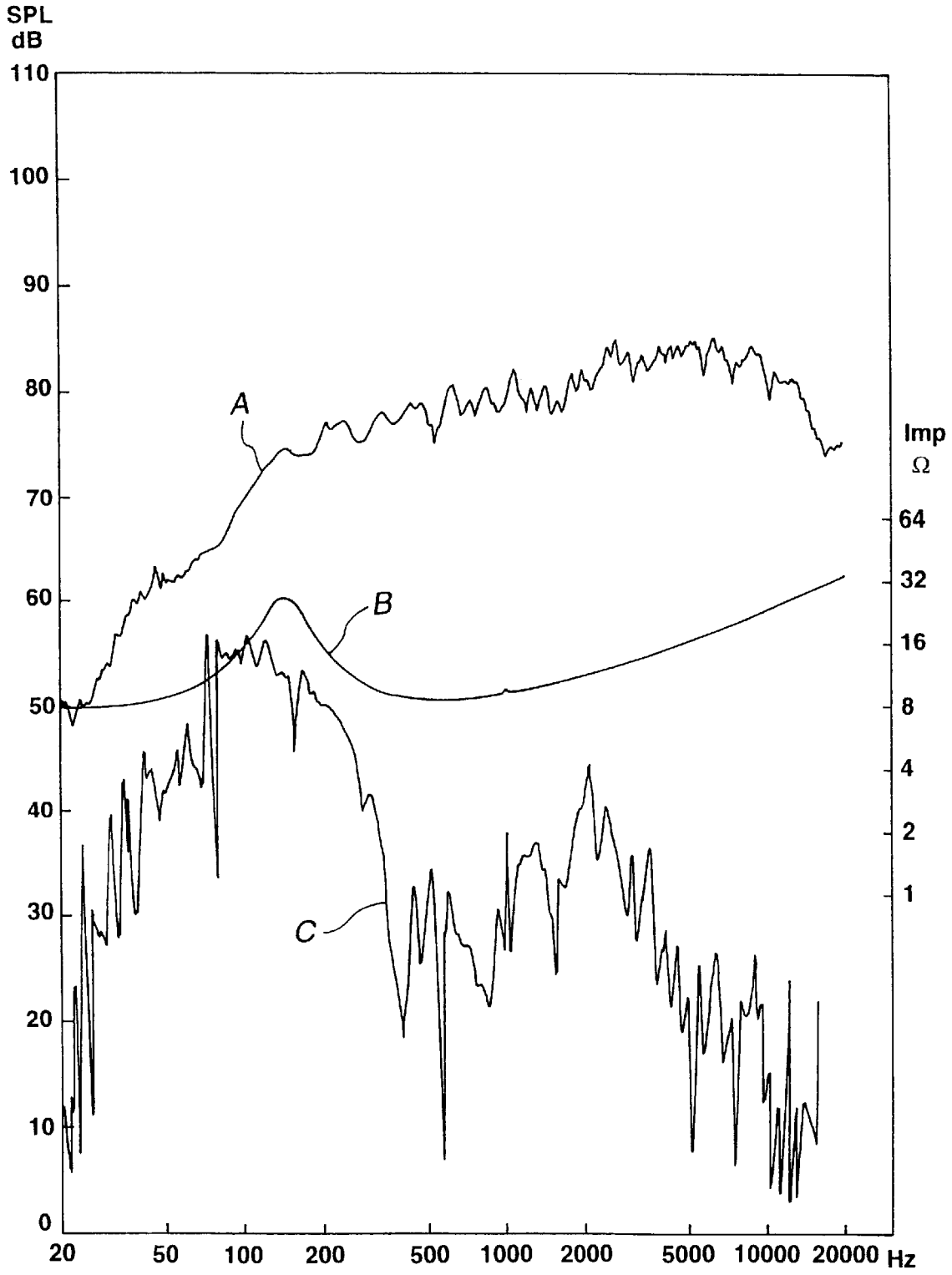
FIG. 25 is a graph showing sound pressure versus frequency characteristics A, impedance versus frequency characteristics B and second harmonics distortion versus frequency characteristics C of a conventional enclosure type speaker device.

As apparent from the graph of FIG. 2, the distortion C in the second harmonics in the speaker device 1 of the present invention is decreased by approximately 10 to 20 dB in the frequency range of from approximately 500 Hz to approximately 5000 Hz as compared to the frequency response of the conventional speaker device shown in FIG. 24. As apparent from the graphs of FIGS. 2 and 24, the speaker device 1 of the present invention is able to reproduce the sound with only little distortion in the mid to high ranges.

Referring to the drawings, a modification 101 of the speaker device according to the present invention is explained.

Figure 3A:
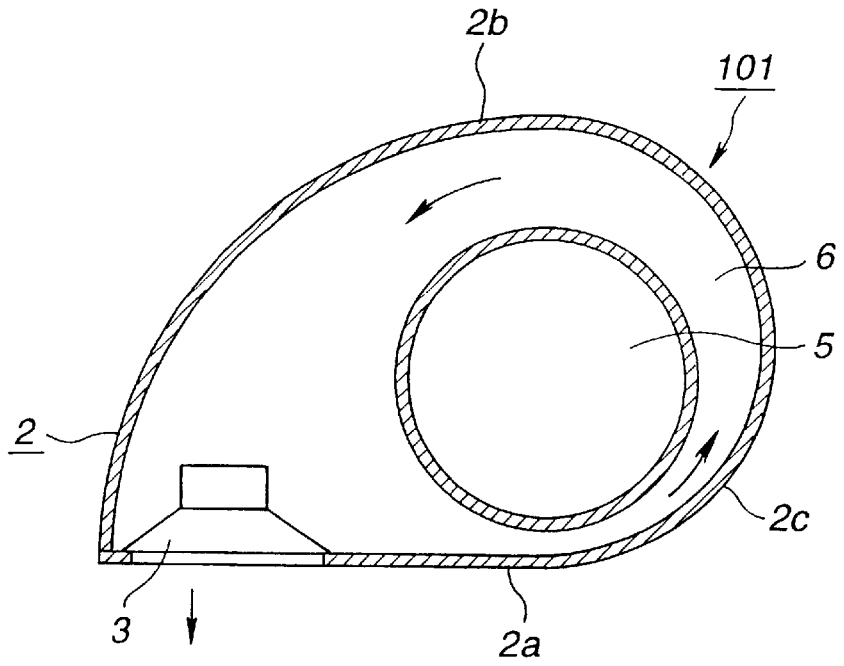
FIG. 3*a* is a cross-sectional view showing an enclosure type speaker device according to the present invention and FIG. 3*b* is a front view thereof.
Figure 3B:
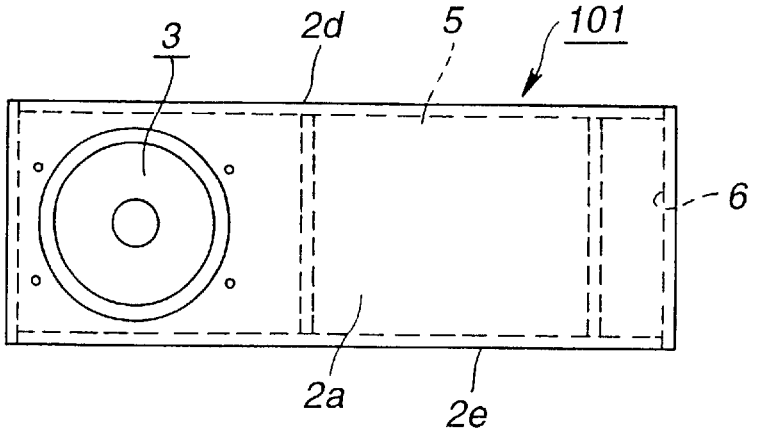

This speaker device 101 is of a hermetically sealed type, as shown in FIGS. 3*a* and 3*b*, without having a duct 4 in the casing 2, as in the above-described speaker device 1.

Since the portions of the speaker device 101 other than the duct 4 are the same as the corresponding portions of the speaker device 1, these common portions are denoted by the common reference numerals and are not explained specifically.

Figure 4:
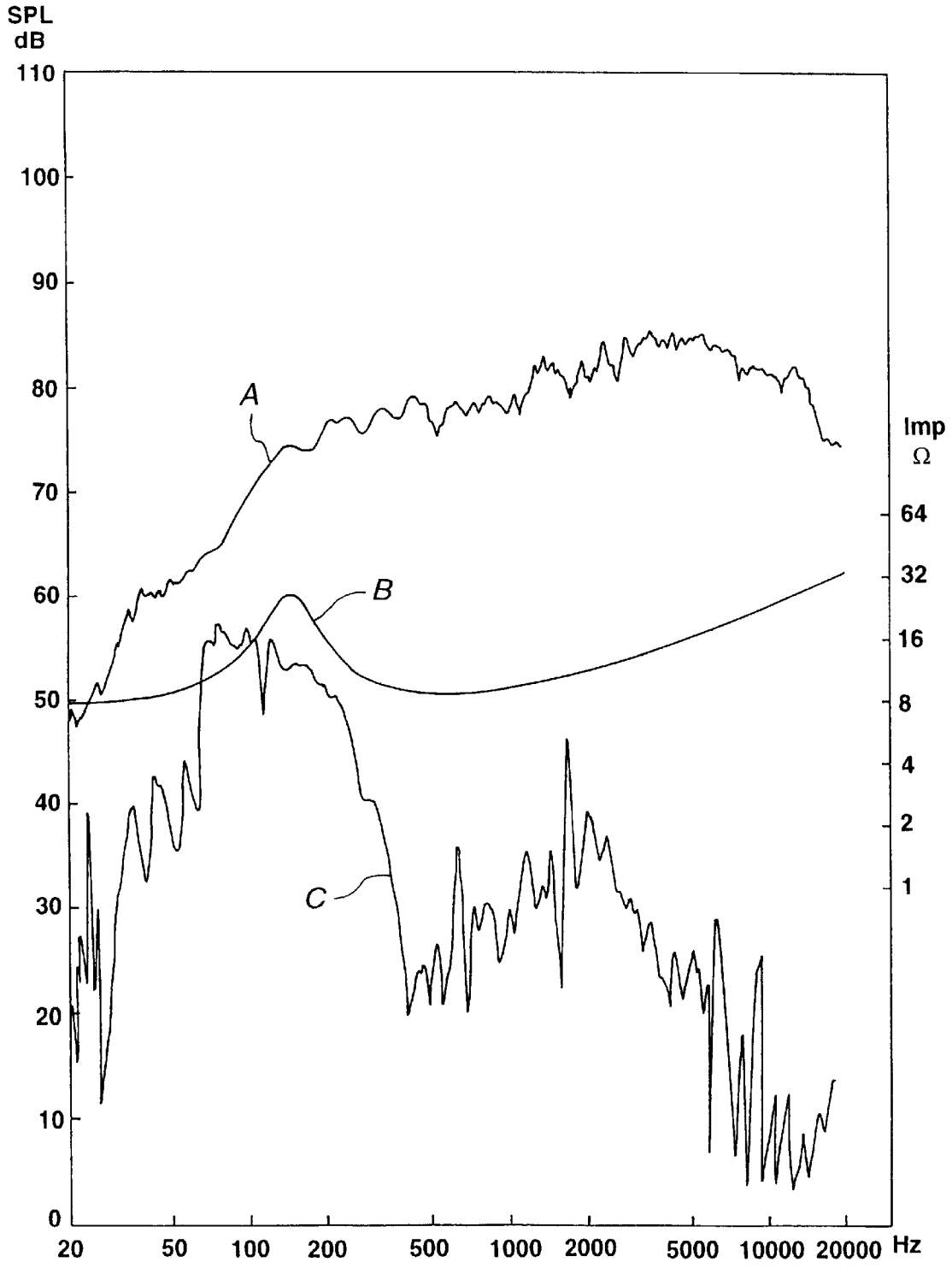
FIG. 4 is a graph showing the relation between the sound pressure, impedance and the secondary harmonics of the speaker device shown in FIG. 3 on one hand and the frequency on the other hand.

In the sound pressure versus frequency characteristics A, impedance versus frequency characteristics B and the second harmonics distortion versus frequency characteristics C of the enclosure type speaker device 101, shown in FIGS. 3*a* and 3*b*, the distortion in the second harmonics is reduced in the frequency range from approximately 500 Hz to 5000 Hz, as shown in FIG. 4. Thus, with the speaker device 101, shown in FIGS. 3*a* and 3*b*, it is possible to reproduce the sound with less distortion, as in the above-described speaker device 1.

Figure 5:
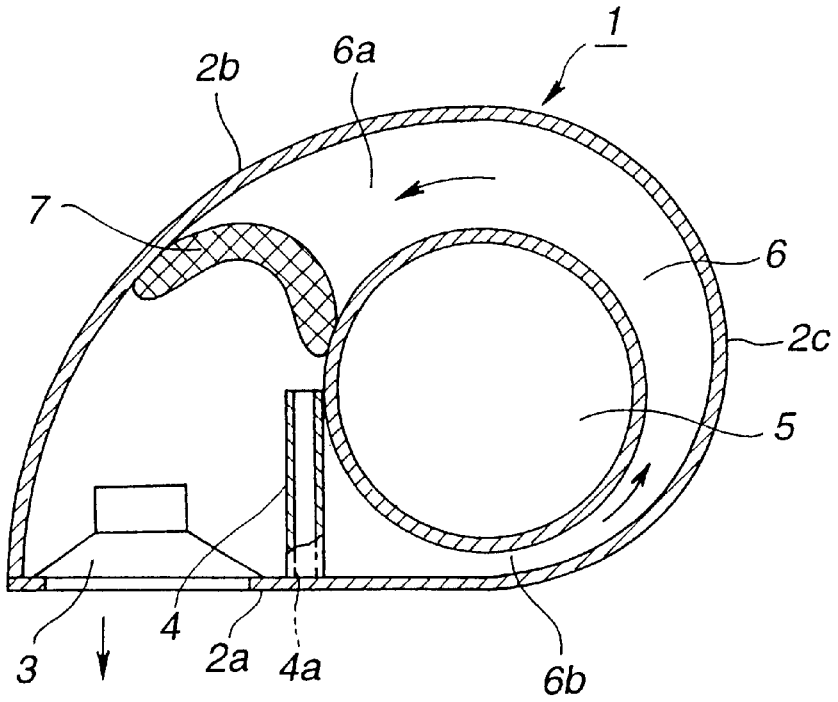
FIG. 5 is a cross-sectional view of a speaker device having a sound-absorbing material arranged in one of the openings so that the sound-absorbing material will have a larger cross-sectional area in the sound duct.
Figure 6:
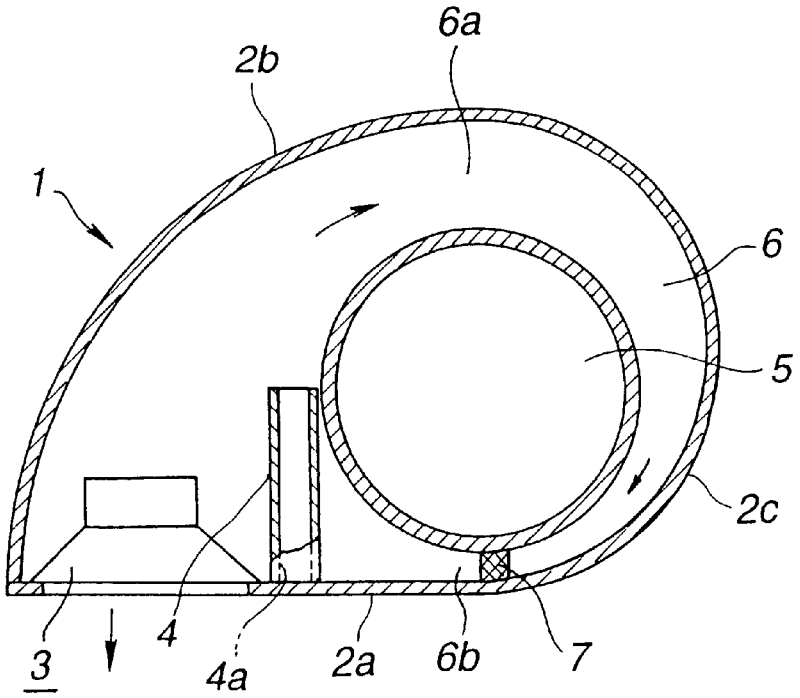
FIG. 6 is a cross-sectional view of a speaker device having a sound-absorbing material arranged in the other opening so that the sound-absorbing material will have a smaller cross-sectional area in the sound duct.
Figure 7:
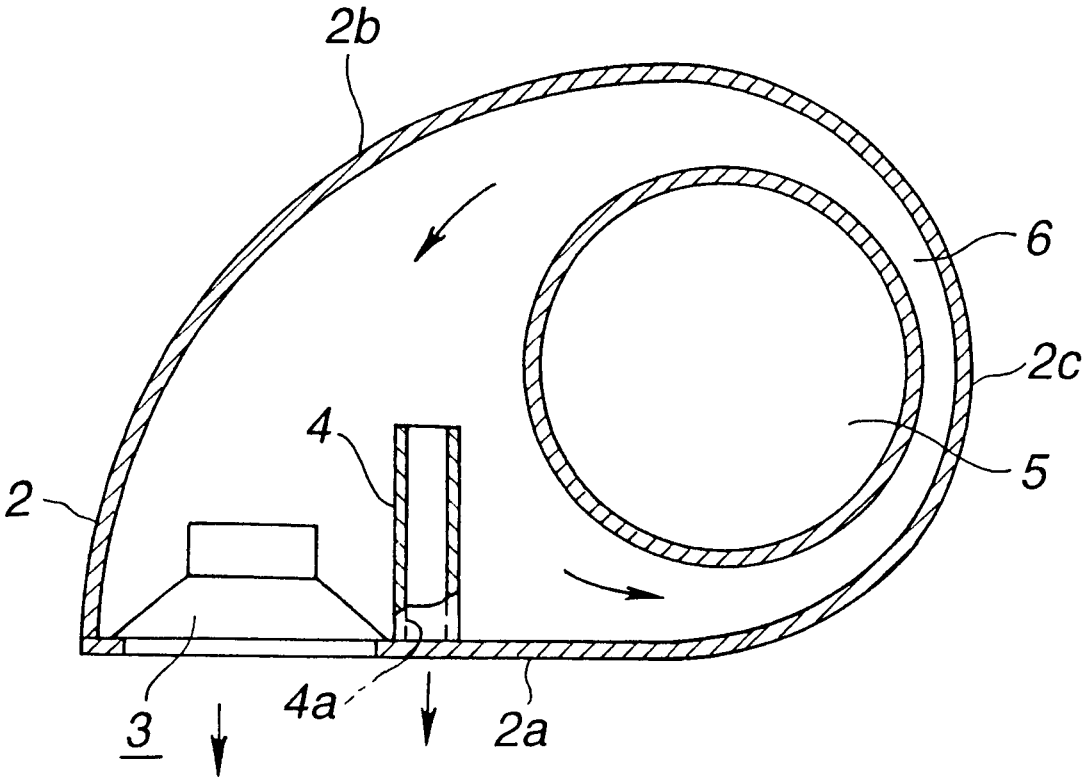
FIG. 7 is a cross-sectional area showing a speaker device arranged so that a tubular member will be substantially concentric with respect to the casing.

In the speaker device 1 of the present invention, a sound absorbing material 7 may similarly be provided in the sound duct 6, as shown in FIGS. 5 and 6. In the speaker device 1 shown in FIG. 5, the sound absorbing material 7 is provided in the vicinity of the opening 6*a* of the sound duct 6 at which enters the sound radiated from the rear side of the speaker unit 3. In the speaker device 1 shown in FIG. 6, the sound absorbing material 7 is provided towards the opposite side opening 6*b* of the duct 6 having the reduced cross-section.

With the speaker device 1, in the inside of the sound duct 6 of which is provided the sound absorbing material 7 as described above, the sound radiated from the rear side of the speaker unit 3 to enter the sound duct 6 can be absorbed and further attenuated in the sound duct 6, thus more reliably suppressing the sound reflected from the r2*b* of the casing 2 to prohibit the reflected sound from again entering the speaker unit 3.

The sound absorbing material 7 arranged in the sound duct 6 may be an air-permeable material having a material having suitable resistance against the sound, such as non-woven fabric, urethane, glass wool, micron glass or expanded material with open cells. The sound attenuating characteristics can be further improved by designing the sound absorbing material 7 so as to be progressively increased in density towards the opening 6*a* from the opening 6*b* of the sound duct 6 via which the sound radiated from the rear side of the speaker unit 3 is admitted into the sound duct 6.

In the above-described speaker device 1, the cylindrically-shaped member 5 is provided at an offset position with respect to the elliptically-shaped portion of the casing 2 extending from the rear wall section 2*b* to the bottom wall section 2*c*. Alternatively, the cylindrically-shaped member 5 may also be provided for extending between both sidewall sections 2*d* and 2*e* so that the center of the cylindrically-shaped member 5 will be coincident with the center of the arcuately-shaped bottom wall section 2*c* continuing to the curved rear wall section 2*b*.

Figure 8:
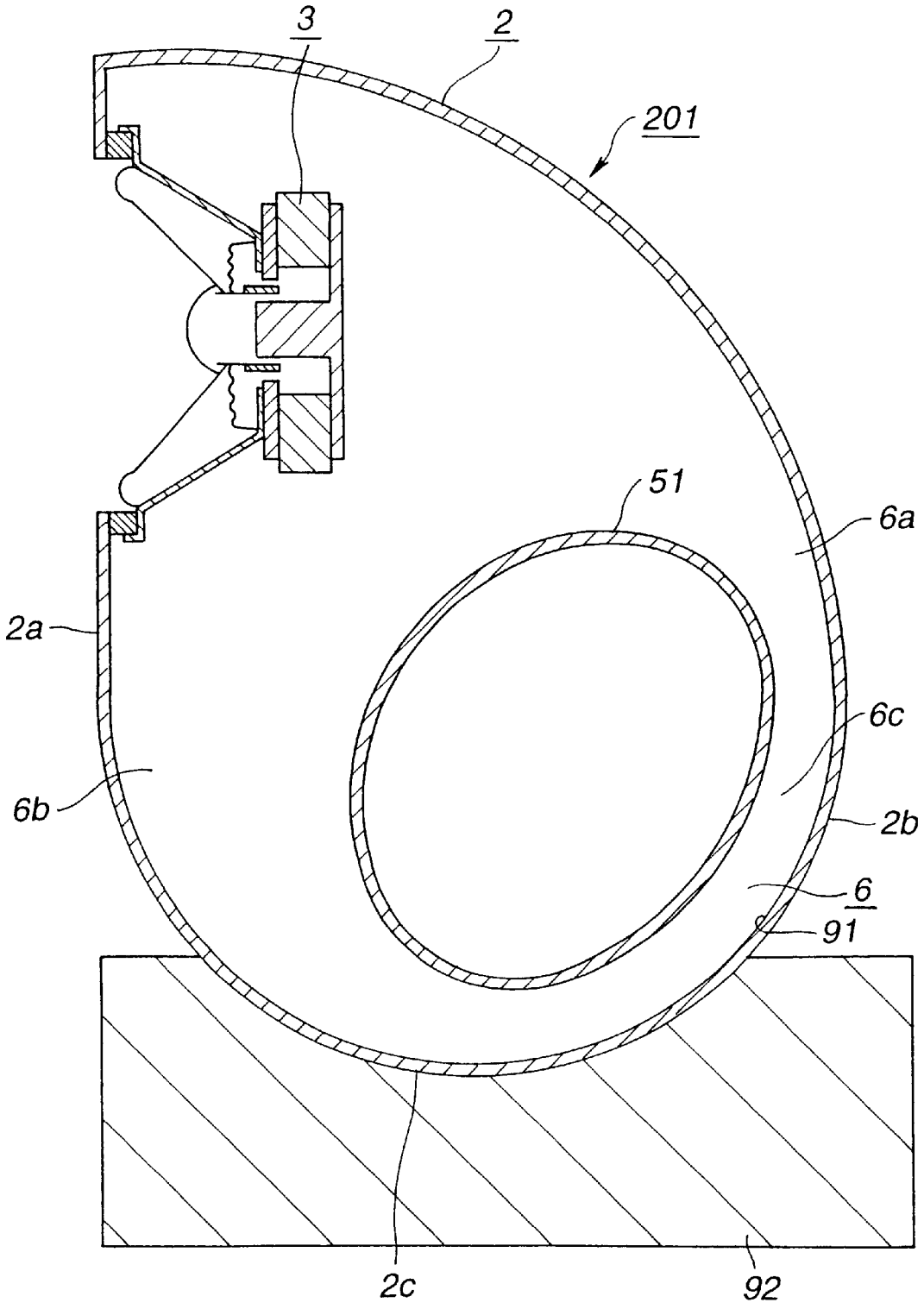
FIG. 8 is a cross-sectional area showing a speaker device having a sound duct arranged so as to be larger and smaller in cross-section towards the one and the other of the openings, respectively.

A tubular member 51 provided for extending across both sidewall sections 2*d*, 2*e* of the casing 2 and which constitutes the sound duct 6 in the casing 2, is formed in an elliptical shape in meeting with an elliptical portion of the casing 2 extending from the rear wall section 2*b* to the bottom wall section 2*c*, as shown in FIG. 8. In distinction from the speaker device 1, shown in FIG. 1, the sound duct 6 is designed so that its portion lying towards the curved rear wall section 2*b* is narrowest in its cross-sectional area and so that its portion of the other side opening 6*b* lying toward the front wall section 2*a* will be maximum in its cross-sectional area.

In the speaker device 201, having the sound duct 6 as shown in FIG. 8, the sound radiated from the rear wall section 2*b* of the speaker unit 3 to enter the sound duct 6 can be absorbed to suppress the sound reflected back into the speaker unit 3.

The speaker device 201, having the curved surface portion from the rear wall section 2*b* to the bottom wall section 2*c* of the casing 2*c*, is mounted on a supporting base block 92 having a fitting recess 91 mating with the curved shape of the casing from its rear wall section 2*b* as far as the bottom wall section 2*c*, as shown in FIG. 8.

Figure 9:
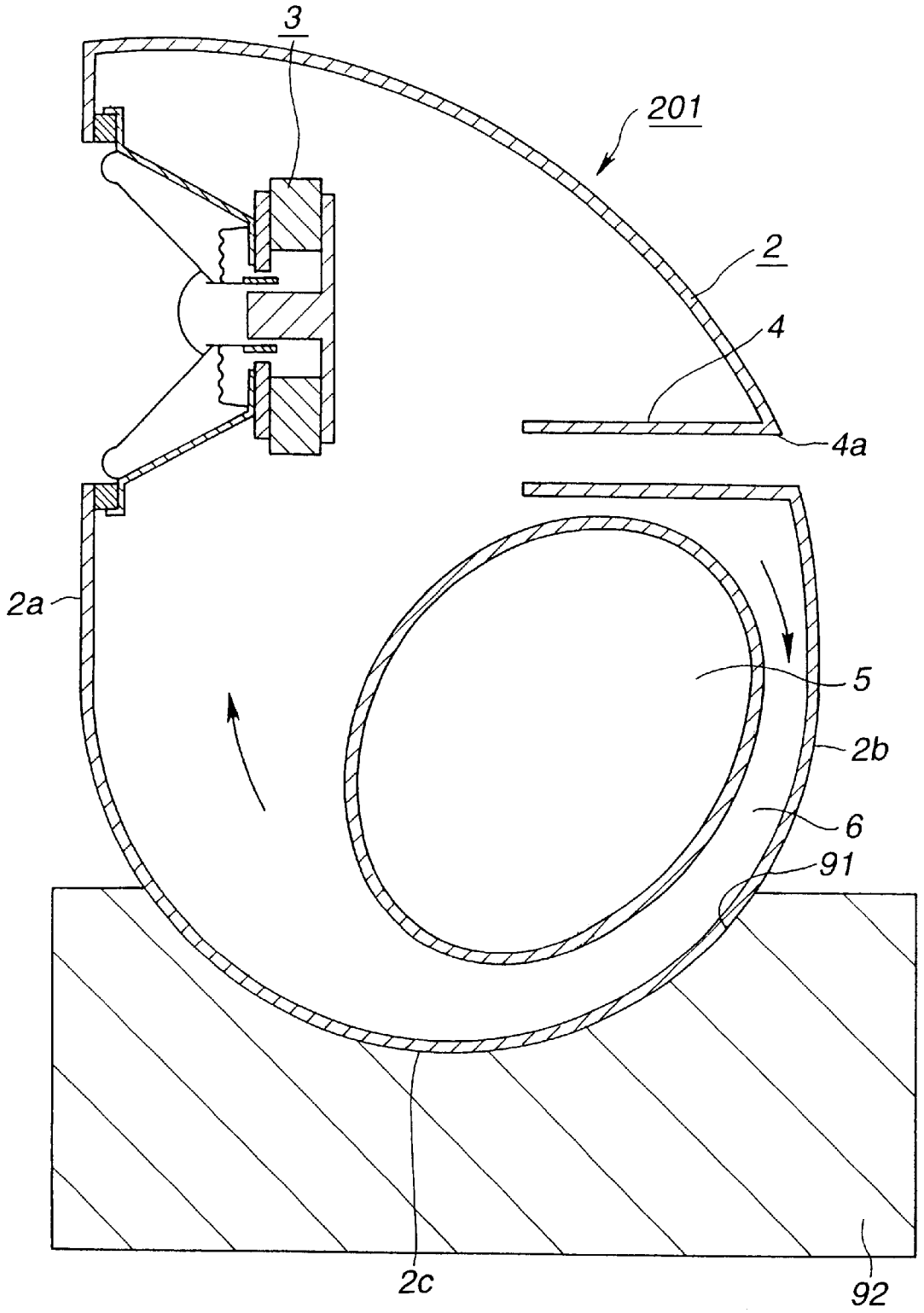
FIG. 9 is a cross-sectional showing speaker device in which a duct is arranged on the back side of the casing.

In the above-described speaker device 1, shown in FIG. 1, the duct 4 is provided in the casing 2 with its opening 4*a* facing the front wall section 2*a* of the casing 2. In the speaker device 201, constructed as shown in FIG. 8, the duct 4 may also be provided with the opening 4*a* facing the rear wall section 2*b* of the casing 2, as shown in FIG. 9.

Figure 10:
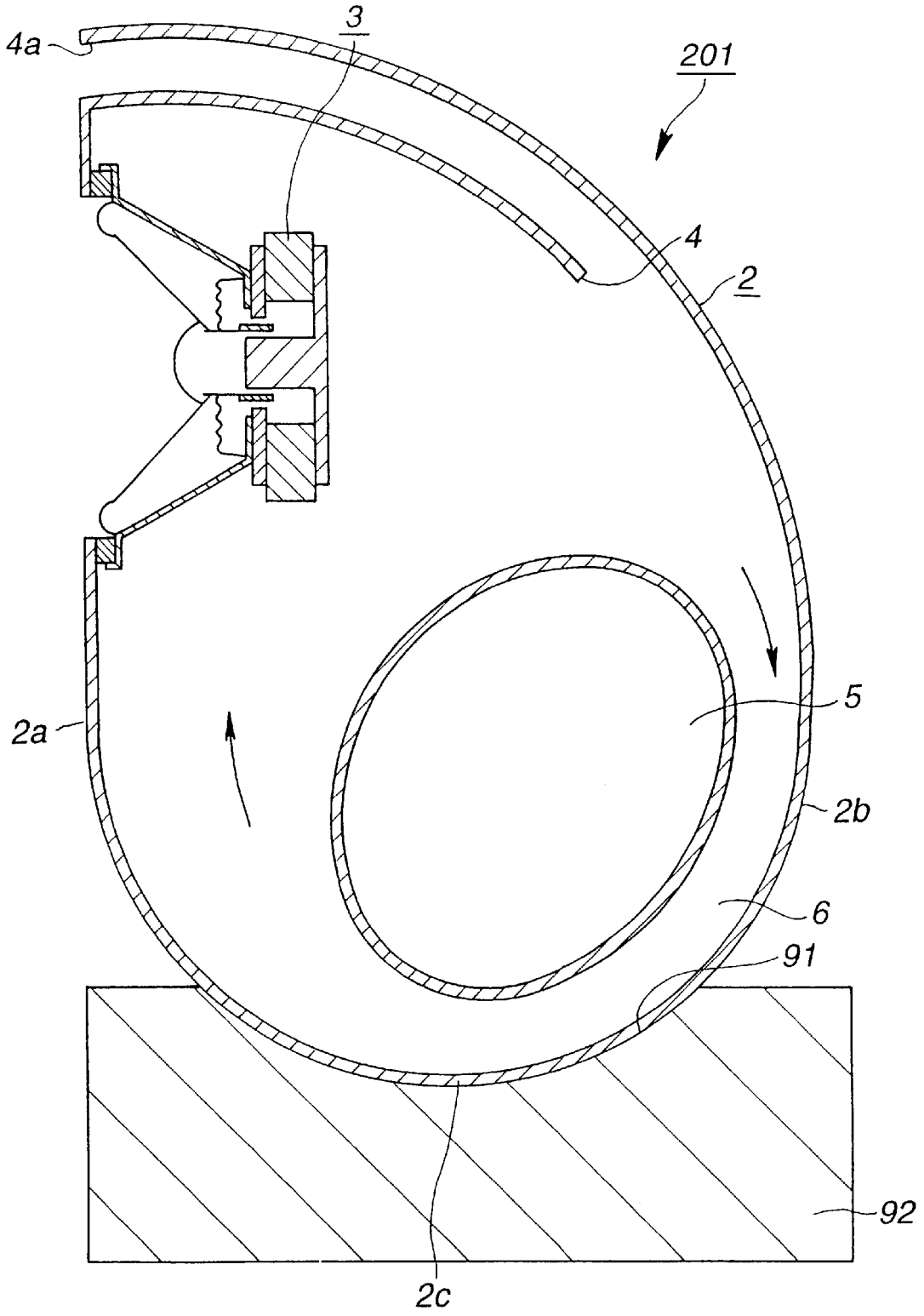
FIG. 10 is a cross-sectional view showing a speaker device lying above a speaker unit arranged on the front side of the casing, with the speaker device being formed with a duct conforming to the cashing shape.

The duct 4, provided in the casing 2, may also be designed so that it is curved to conform to the curved rear wall section 2*b*, with its opening 4*a* facing the front wall section 2*a* of the casing 2, as shown in FIG. 10. That is, the duct 4 may also be formed by making use of the rear wall section 2*b* of the casing 2.

Figure 11:
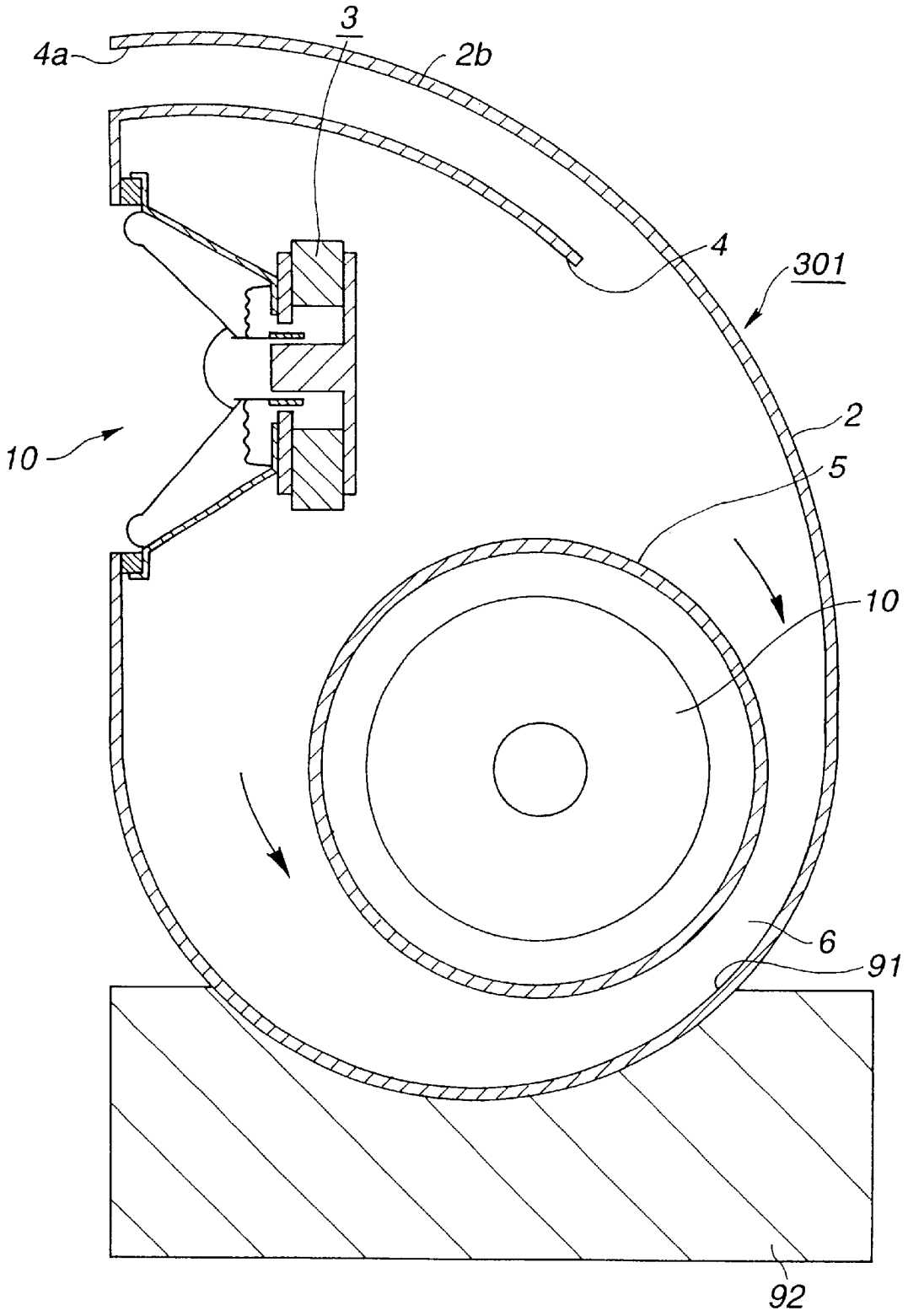
FIG. 11 is a cross-sectional of a speaker device having another speaker device fitted in a through-hole thereof.
Figure 12:
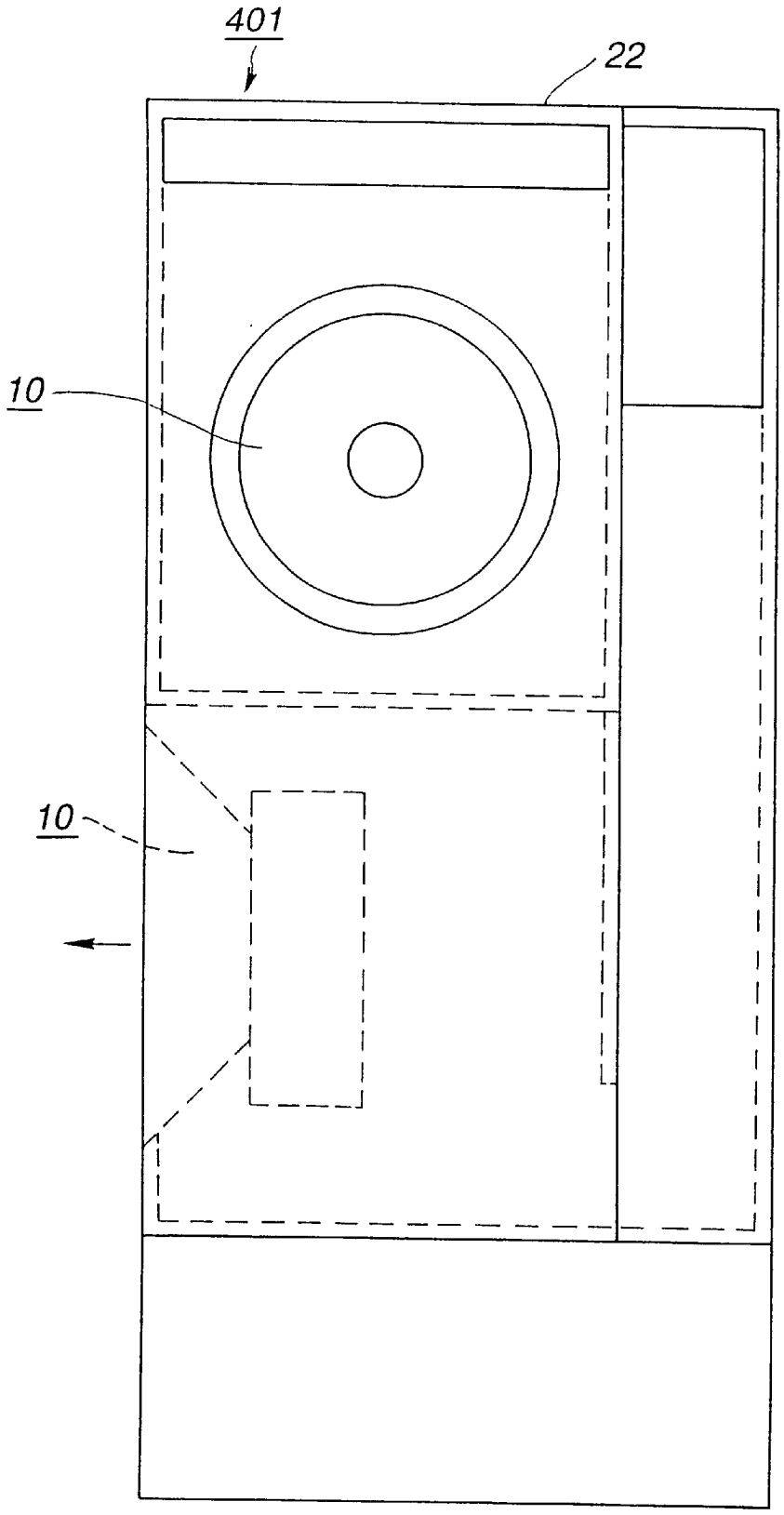
FIG. 12 is a front view showing the speaker device shown in FIG. 11.

Referring to FIGS. 11 and 12, a speaker unit 10 separate from the speaker unit 3 provided in the casing 2 may be provided in the casing 5 the finding sound the sound duct 6 in the casing 2. FIG. 11 shows a cross-section of a speaker device 301 carrying the speaker unit 10 in the above cylindrically-shaped member 5. In FIG. 12, the speaker unit 10 is mounted on a speaker device 401 having a casing 22 in the shape of a parallelepiped. The speaker unit 10 mounted in the casing 5 is use provide high sound pressure level for the low frequency range. The speaker unit 10, mounted n the cylindrically-shaped member 5, is such a unit which has a high sound pressure level in the low frequency range. Alternatively the device mounted on the cylindrically-shaped member 5 may be any electronic device, other than the speaker unit 10, which is designed to furnish acoustic signals serving as a sound source for the speaker devices 301, 401, such as a disc player or a tape recorder.

Figure 13:
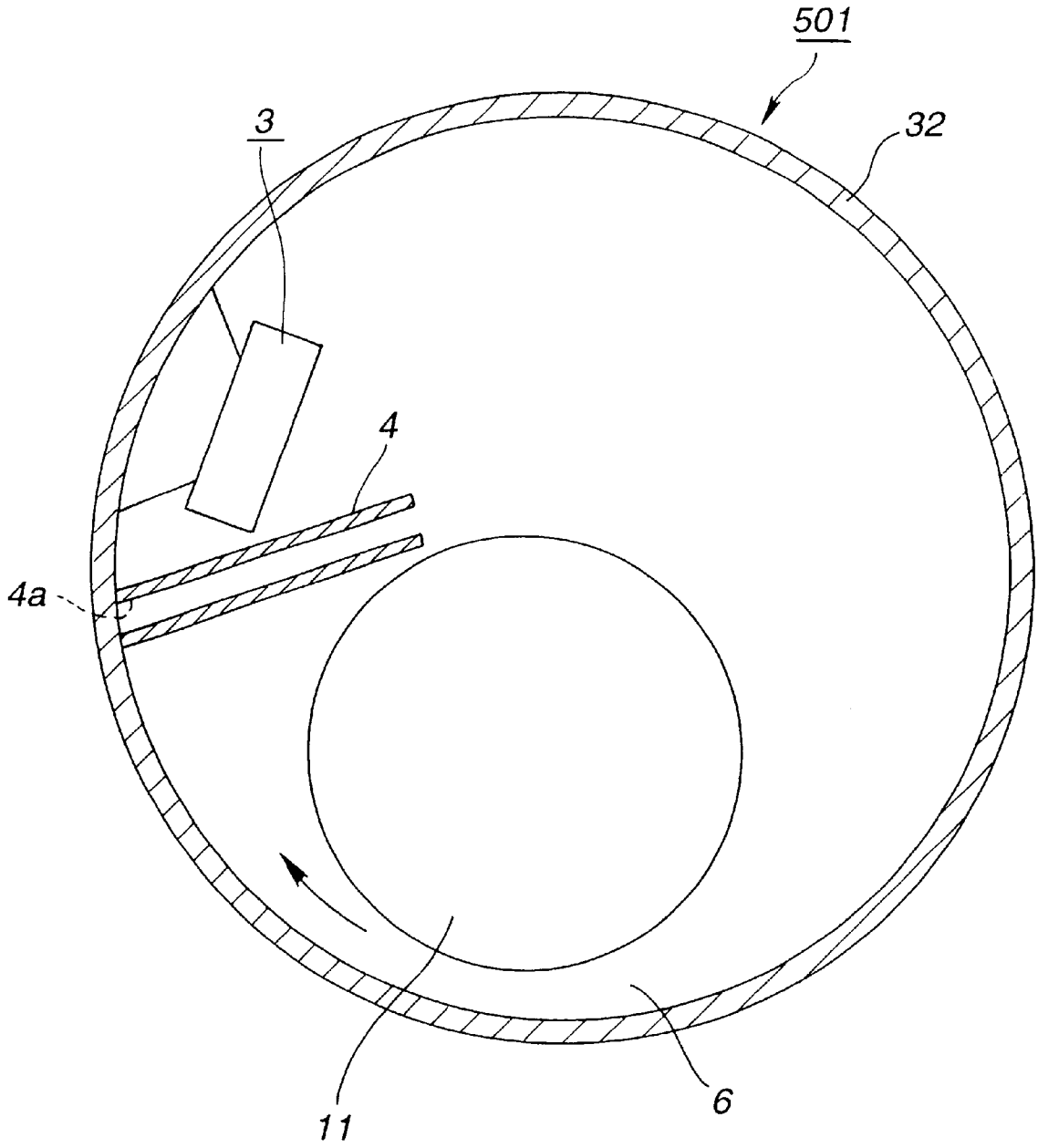
FIG. 13 is a cross-sectional view in which the sound duct is formed by having a spherically-shaped casing and by providing a spherical space in the casing.

Referring to FIG. 13, the sound duct 6 may be provided by forming a casing 32 in a spherical shape and arranging a spherically-shaped member 11 in the inside of the spherically-shaped casing 32. The inside space of the spherically-shaped member 11 is provided at a position offset from the center of the spherically-shaped casing 32.

In FIG. 13, parts or components denoted by the same reference numerals as in FIG. 1 are the same parts or components as those of the speaker device 1 shown in FIG. 1.

Figure 14:
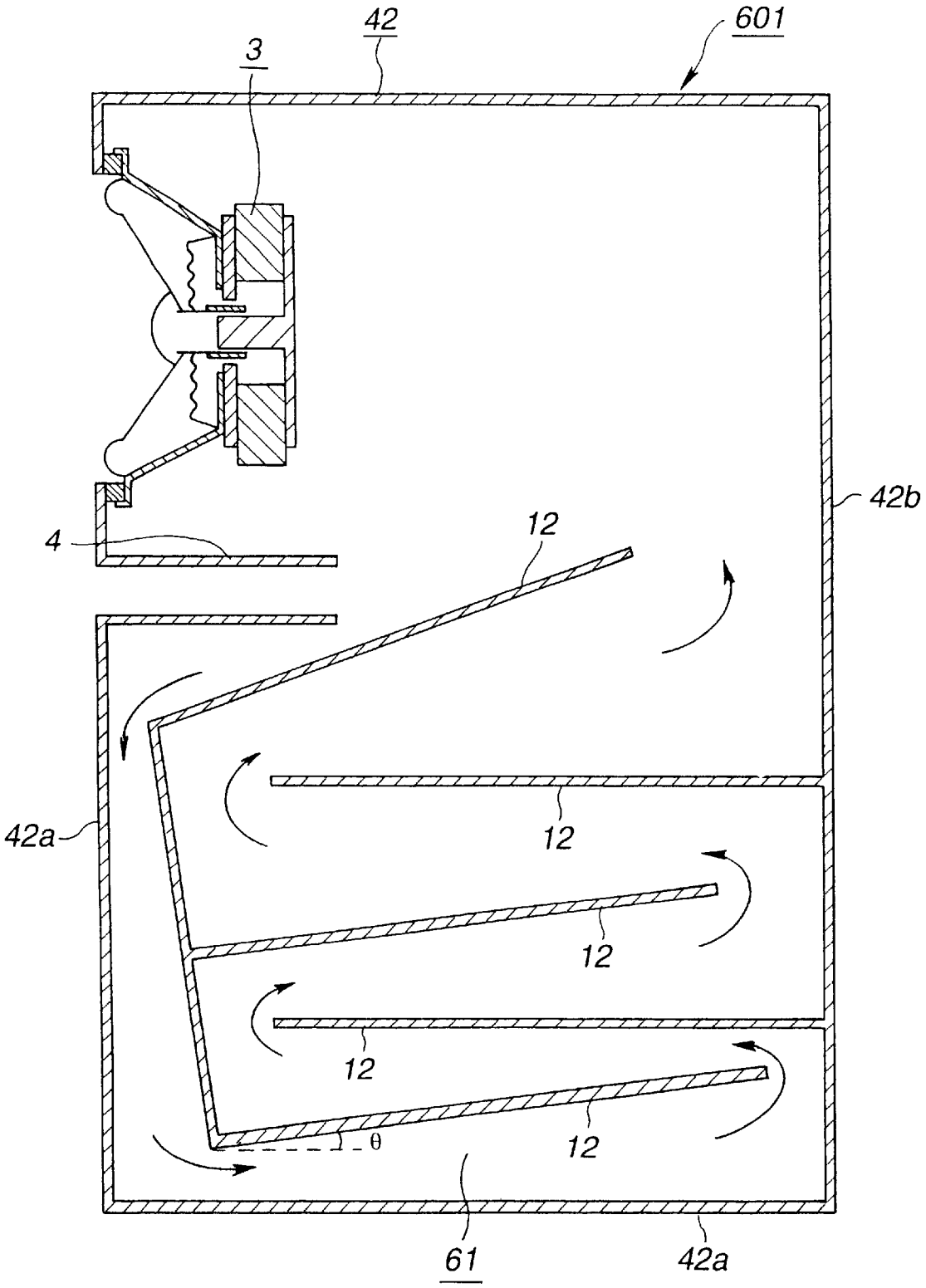
FIG. 14 is a cross-sectional showing a speaker device in which the sound duct is defined by providing plural overlapped partitioning plates.

In a speaker device 601 of the present invention, shown in FIG. 14, a number of partitioning plates 12 are arrayed in tiers in a staggered relation in a rectangular casing 42, provided with the speaker unit 3 and with the duct 4, to constitute a sound duct 61. In the sound duct 61, constituted by the partitioning plates 12, the sound radiated from the rear side of the speaker unit 3 into the inside of the casing 42, is transmitted as indicated by arrows in FIG. 14. In the speaker device 601, shown in FIG. 14, the partitioning plates 12, constituting the sound duct 61, are arranged at a pre-set angle of inclination θ relative to the bottom wall section 42*c* of the casing 42, in order that the sound radiated from the rear side of the speaker unit 3 will be efficiently transmitted through the sound duct 61.

Figure 15:
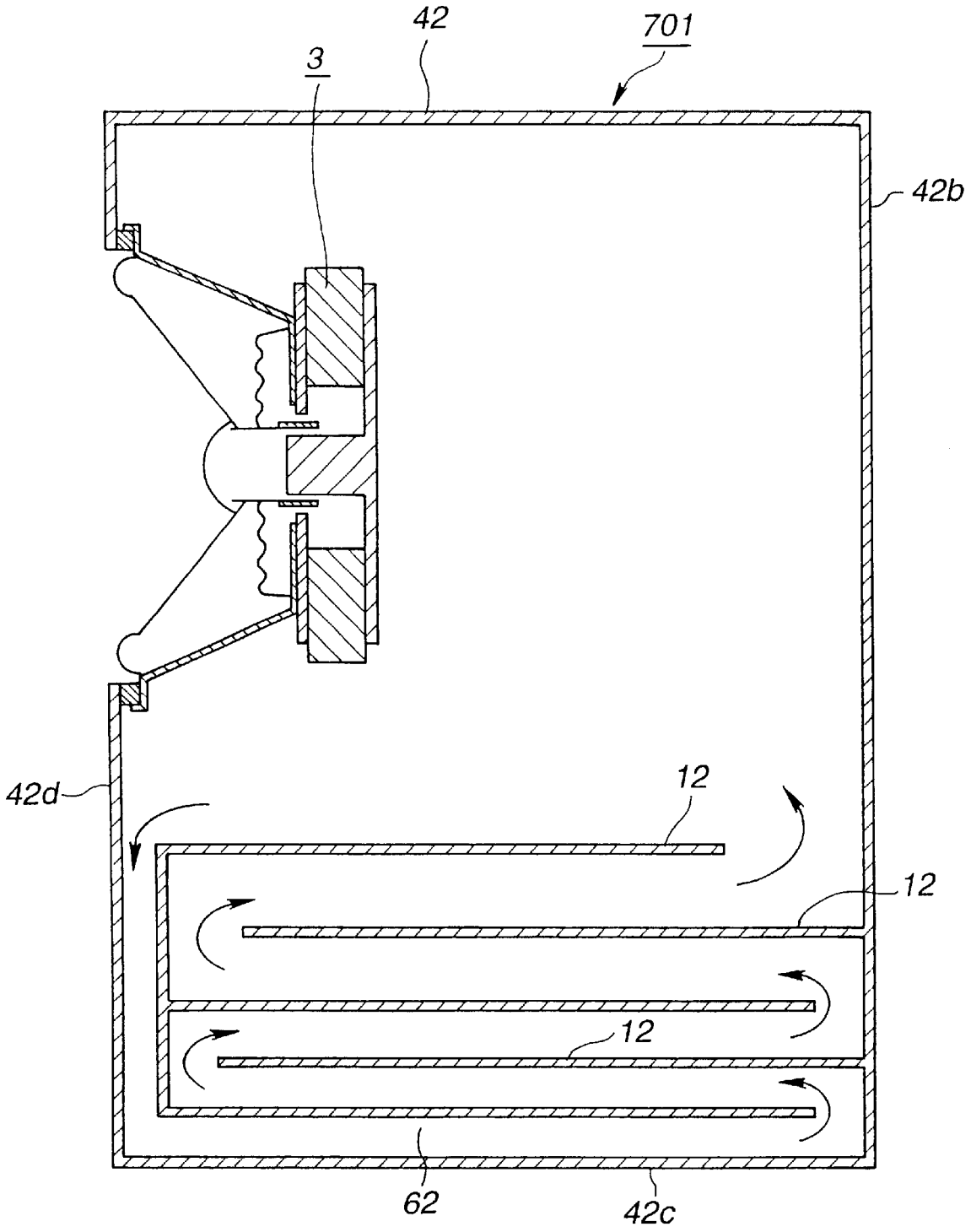
FIG. 15 is a cross-sectional for illustrating a speaker device the sound duct of which is changed in width by arranging the partitioning plates.
Figure 16:
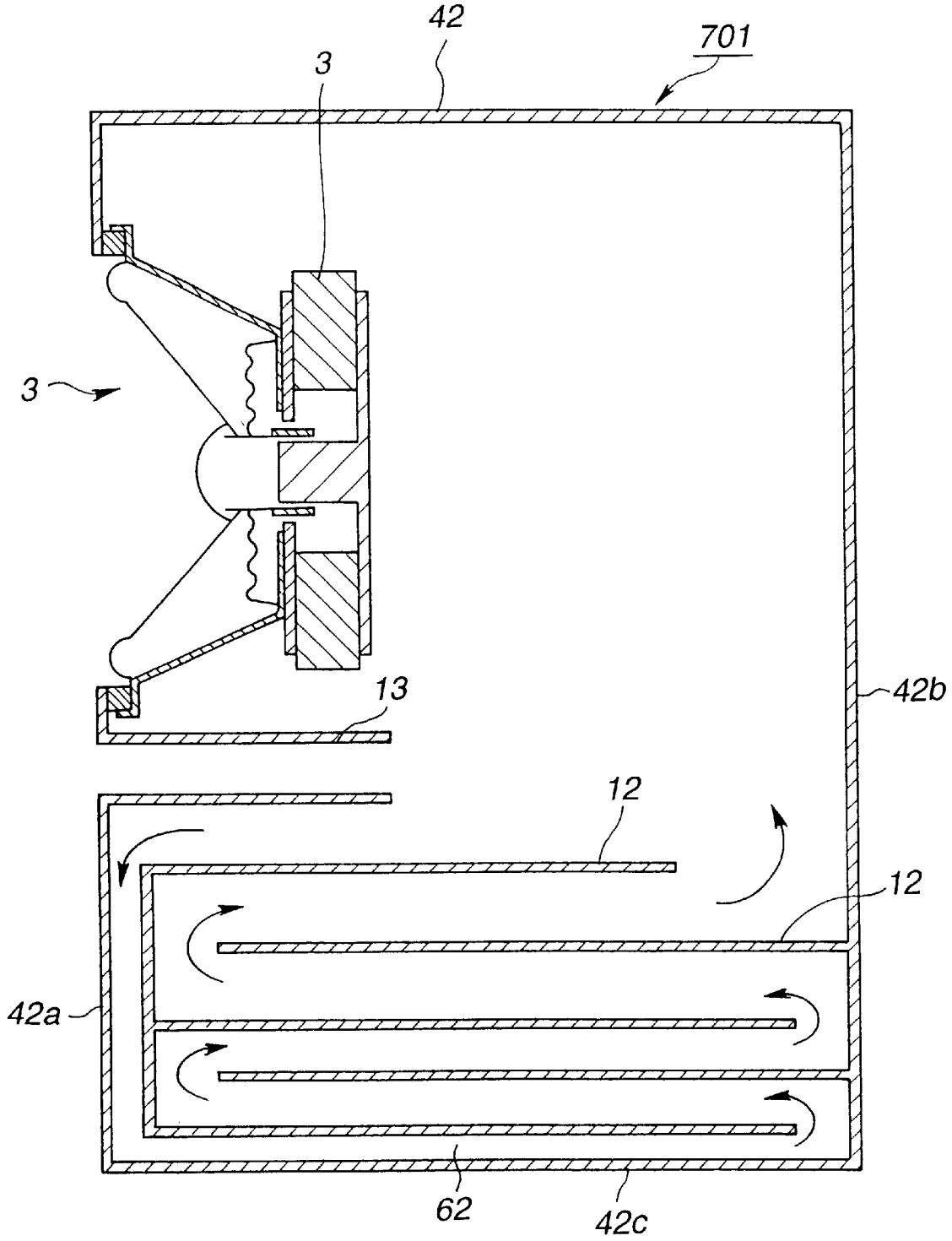
FIG. 16 is a cross-sectional view showing a speaker device which is the speaker device of FIG. 15 fitted with a duct.

Referring to FIG. 15, a speaker device 701 of the present invention may be designed so that the separation between neighboring partitioning plates 12 of the sound duct 62 is varied to change the width of the sound duct 62. By varying the width of the sound duct 62, it is possible to control the attenuation of the sound radiated from the rear side of the speaker unit 3 into the inside of the casing 42. Also, a duct 4 may be provided in the speaker device 701 shown in FIG. 15. This duct 4 is positioned between the speaker unit 3 mounted on the front wall section 42*a* of the casing 42 and the sound duct 62 provided on the bottom wall section 42 so of the casing 42 so that its opening 4*a* is adjacent faces the bottom wall section 42*a* as shown in FIG. 16.

Figure 17:
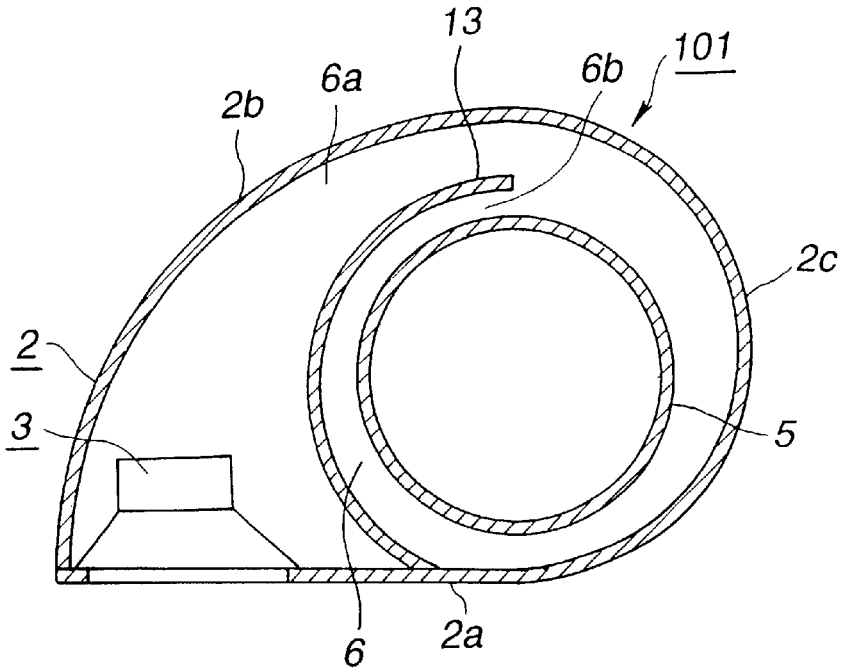
FIG. 17 is a cross-sectional view having the sound duct formed by arranging the partitioning plates in the inner space of the casing for extending along the through-hole.

In the speaker device 101, shown in FIGS. 3*a*and 3*b* a partitioning plate 4 for partitioning the inner space of the casing 2 along the outer periphery of the tubular member 5 may be provided for elongating the sound duct 6 along the outer surface of the cylindrically-shaped member 5, as shown in FIG. 17. By elongating the sound duct 6 in this manner, the opening 6*b* is caused to face the rear wall section 2*b* of the casing 2, as shown in FIG. 17, thus reliably prohibiting the sound traversing the sound duct 6 and radiated from the opposite side opening 6*b* from being admitted into the speaker unit 3.

Figure 18:
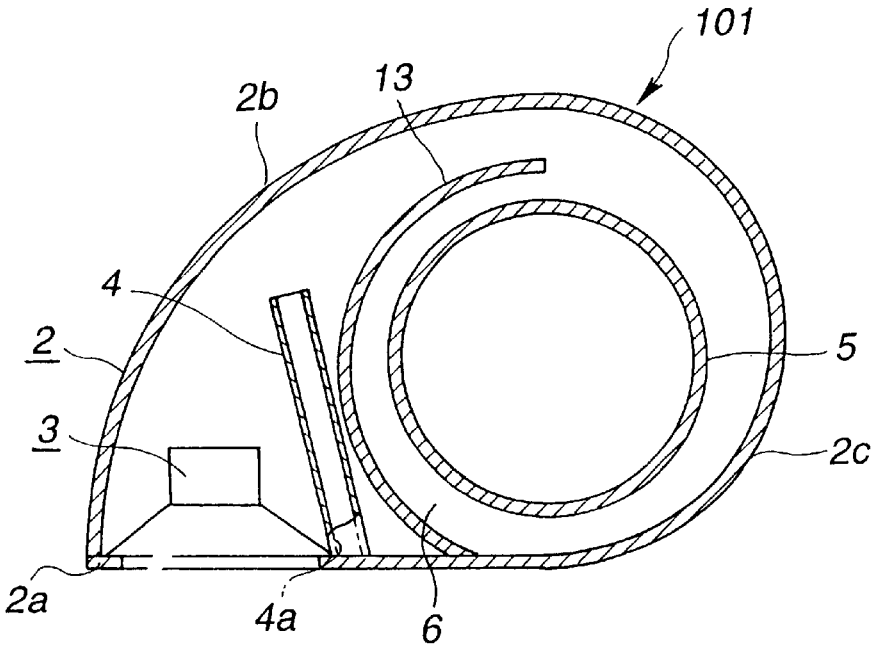
FIG. 18 is a cross-sectional view showing a speaker device having a duct formed on the front side of the speaker device shown in FIG. 17.

In a speaker device 101, shown in FIG. 18, the duct 4 may be provided so that its opening 4*a* faces the front wall section 2*a* of the casing 2. If this duct 4 is provided, the sound pressure in the low range of the sound radiated from the speaker unit 3 can be increased further.

Figure 19:
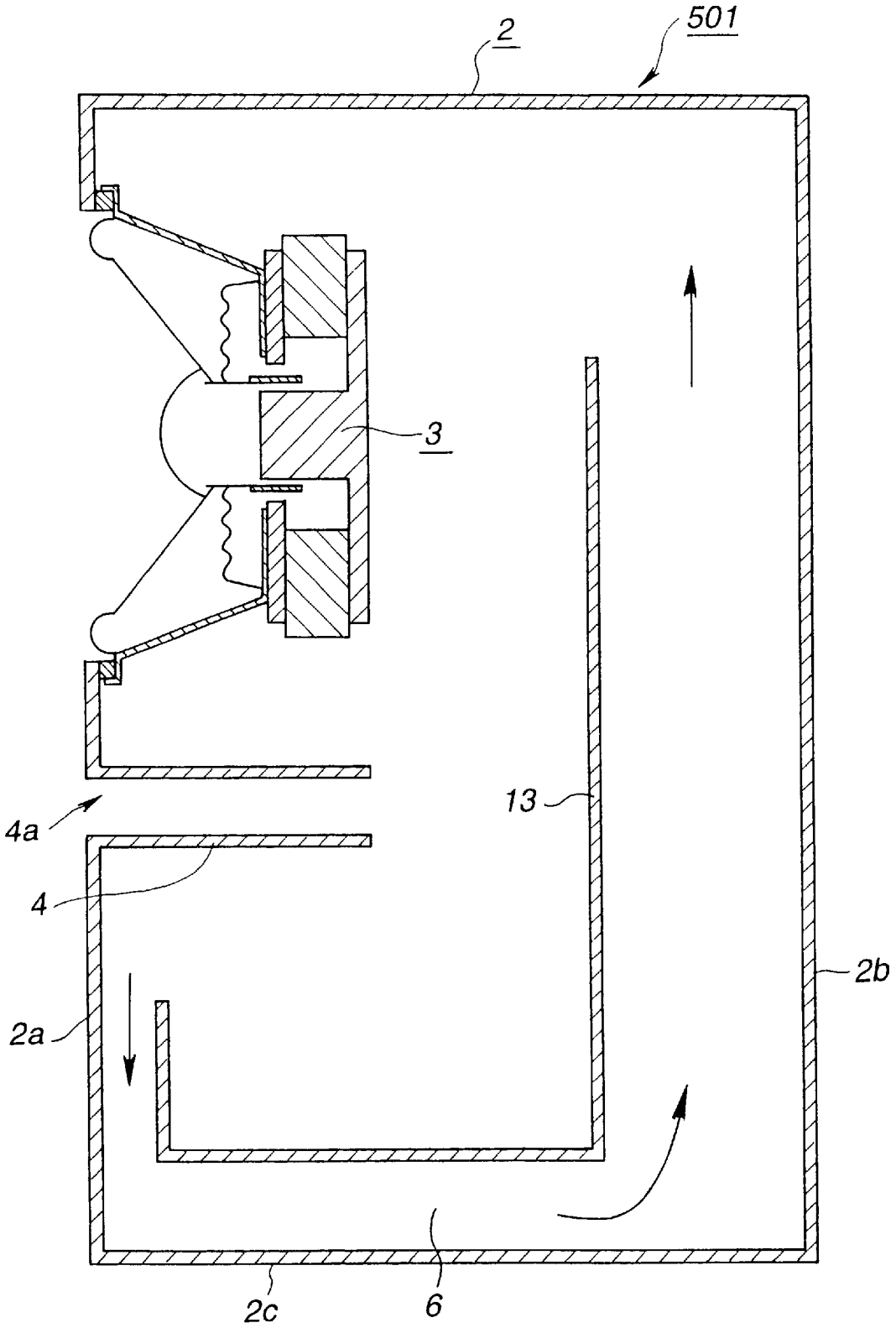
FIG. 19 is a cross-sectional view showing a speaker device having a cubically or parallelepipedically shaped casing in the inside of which a partitioning plate is arranged for defining a sound duct.

In a speaker device 801, employing the cubically- or parallelepipedically-shaped casing 2, a partitioning plate 43 for partitioning the inside of the casing 2 along the front wall section 2*a*, bottom wall section 2*c* and the rear wall section 2*b* may be provided for defining a substantially U-shaped sound duct 6, as shown in FIG. 19. In this manner, the sound radiated from the speaker unit 3 may be prohibited from entering the speaker unit 3, without it being necessary to provide the curved surface of the rear wall section 2*b*, thus achieving the results similar to those obtained with the speaker device 1 shown in FIG. 1.

In the speaker device, shown in FIG. 19, there is provided the duct 4 having its opening 4*a* facing the front wall section 2*a*.

An embodiment of the present invention, applied to an earphone, is hereinafter explained.

Figure 20A:
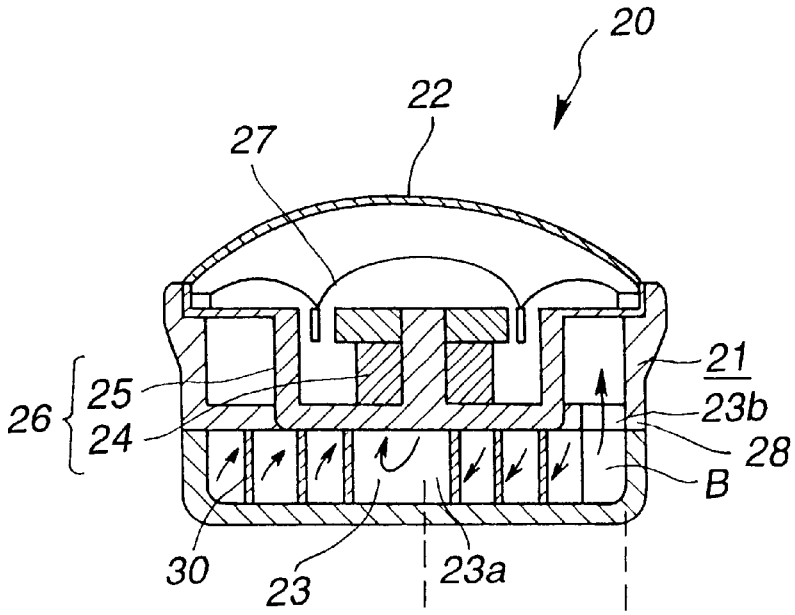
FIG. 20*a* is a cross-sectional view showing an instance of application of the present invention to an earphone and FIG. 20*b* illustrates the sound duct provided in the earphone.
Figure 20B:
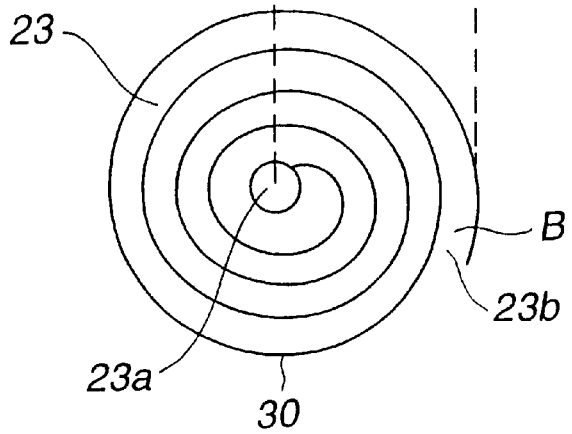

Referring to FIG. 20*a*, an earphone 20 according to the present invention includes a magnetic circuit unit 26, having a magnet 24 and a yoke 25, an earphone unit 21, carrying a diaphragm 27 carried by the yoke 25 of the magnetic circuit unit 26, and a frame 28 housing this earphone unit 21. On the front side of the frame 27, a dome-shaped protector 22 is provided for covering the diaphragm 27 of the earphone unit 21. In a spacing 29 defined by the back side of the earphone unit 21 and the frame 27, there is provided a helically-shaped sound duct 23, as shown in FIG. 20*a*. This sound duct 23 is formed by providing a spirally-shaped partitioning wall section 30 in the spacing 29, as shown in FIG. 20*b*.

The sound radiated from the back side of the earphone unit 21 is admitted into an opening 23*a* of the helically-shaped sound duct 23 and is transmitted towards an opposite side opening 23*b* as it undergoes repeated reflection in the sound duct 23. The sound radiated from the back side of the earphone unit 21 enters the sound duct 23 and is attenuated due to repeated reflection in a sound duct 23*b* so that it is prohibited from re-entering the earphone unit 21 to reduce noise components superimposed on the mid to high range of the playback sound radiated from the earphone unit 21to improve acoustic characteristics of the mid to high frequency range.

Figure 21A:
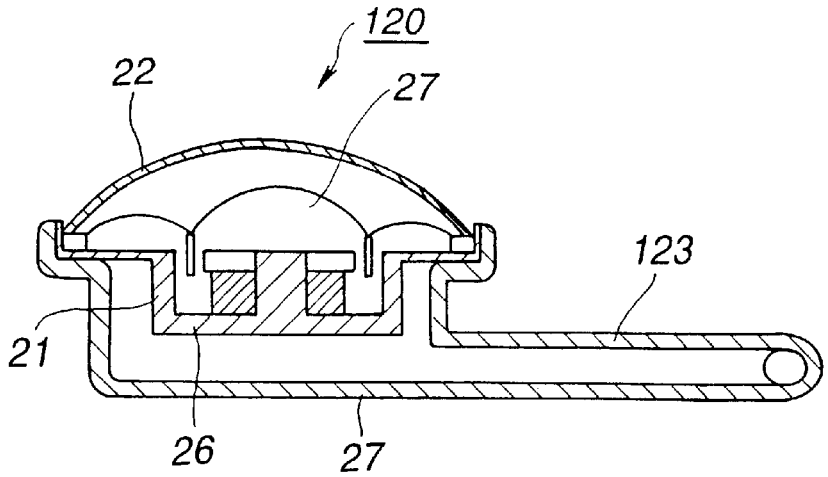
FIG. 21*a* is a cross-sectional view showing another instance of application of the present invention to an earphone and FIG. 21*b* is a plan view thereof.
Figure 21B:
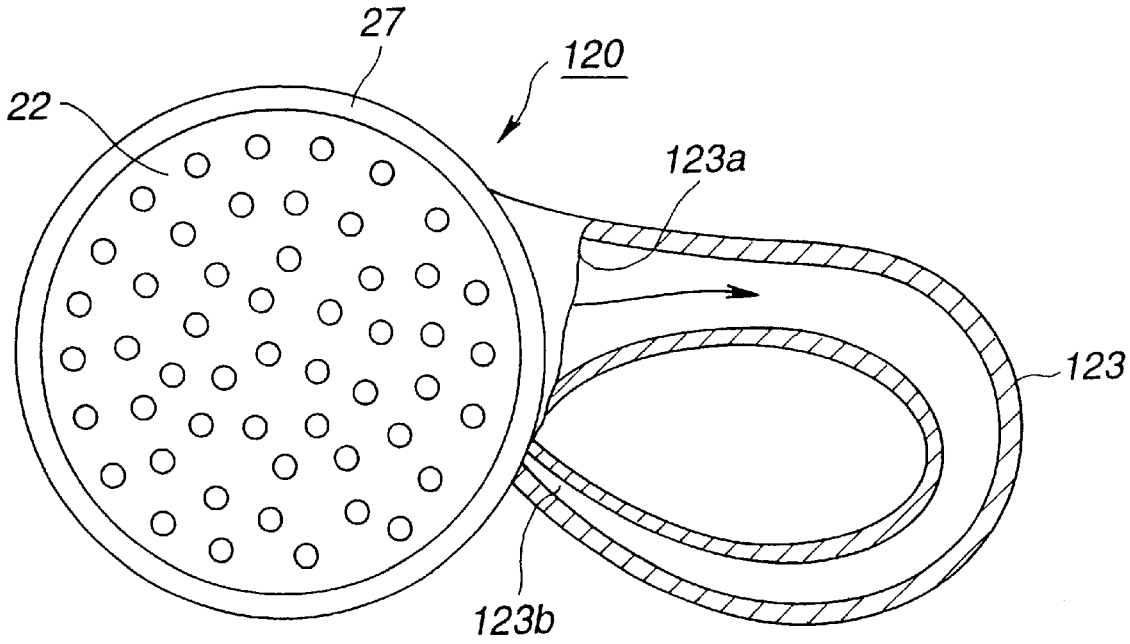

An earphone unit 120 according to the present invention may be integrally provided with an elliptica ring shaped sound duct 123 in a frame 27 housing the earphone unit 21, as shown in FIG. 21*a*. This sound duct 123 is formed so that an opening area 21 will be increased towards the opening 123*a* in which is admitted the sound radiated from the rear side of the earphone unit and so that the opening area will be progressively reduced towards the opposite side opening 123*b*, as shown in FIG. 21*b*.

In this earphone 121, the sound radiated from the back side of the earphone 21 is incident via the opening 123*a* on the sound duct 123 to undergo attenuation on being repeatedly reflected in this sound duct 123, so that noise components superimposed on the mid to high frequency ranges of the reproduced sound from the earphone unit 21 can be diminished to improve acoustic characteristics of the mid to high ranges.

An instance of application of the present invention to a microphone device is hereinafter explained.

Figure 22:
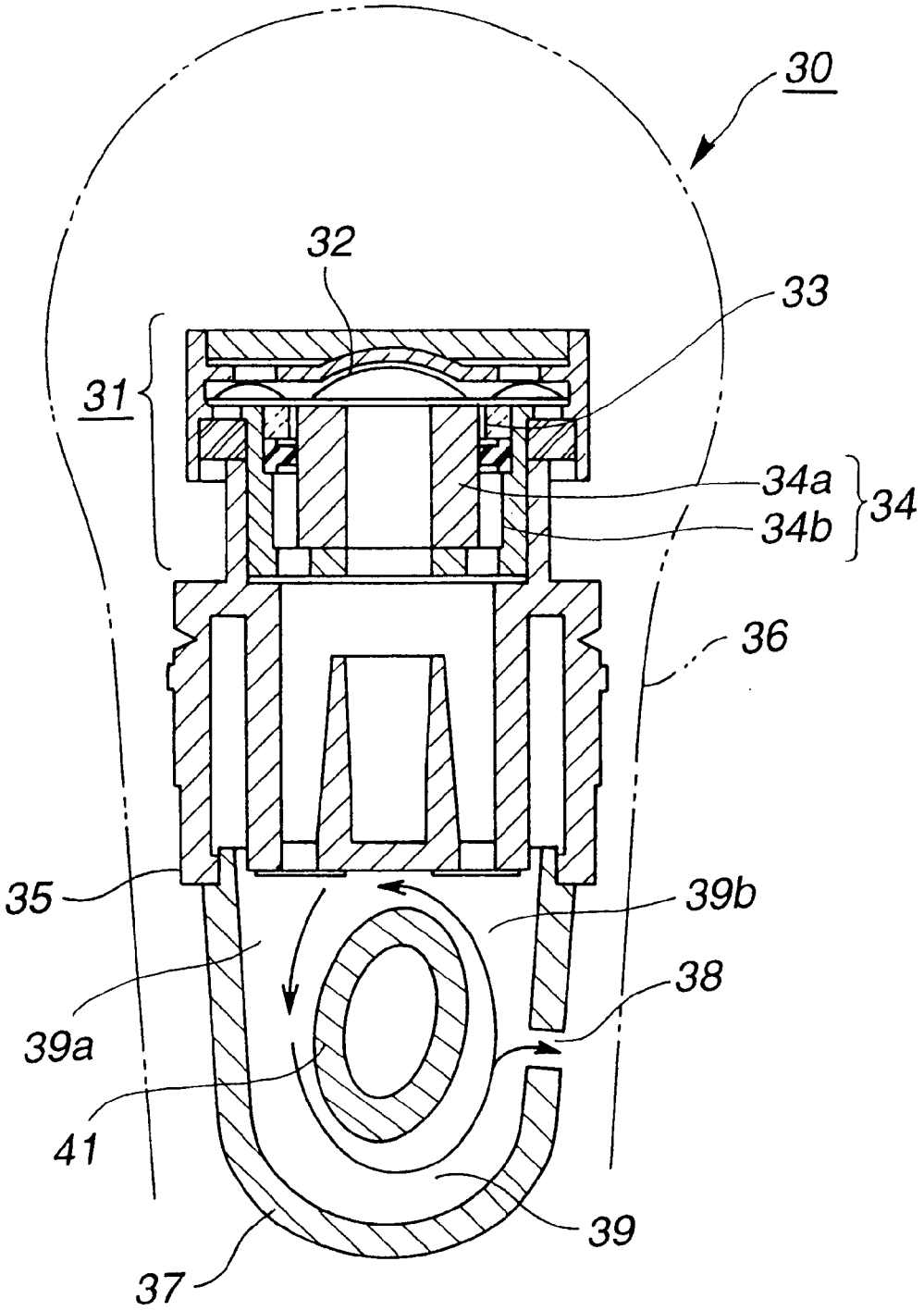
FIG. 22 is a cross-sectional view showing an instance of application of the present invention to a microphone device.
Figure 23B:
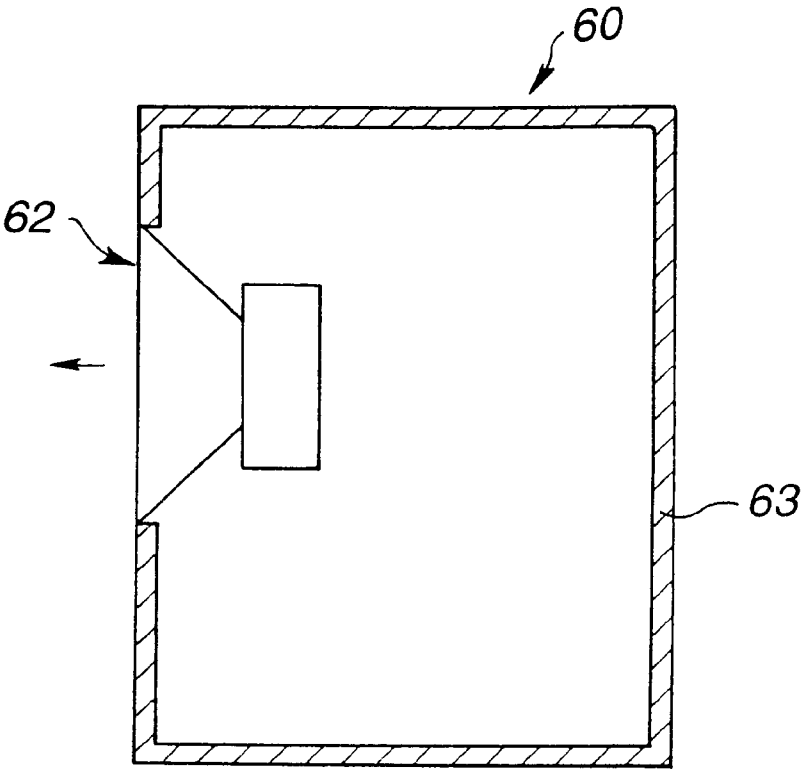
FIG. 23*a* is a cross-sectional view showing a conventional bass-reflex type speaker device and FIG. 23*b* is a cross-sectional view showing a conventional enclosure type speaker device.
Figure 23A:
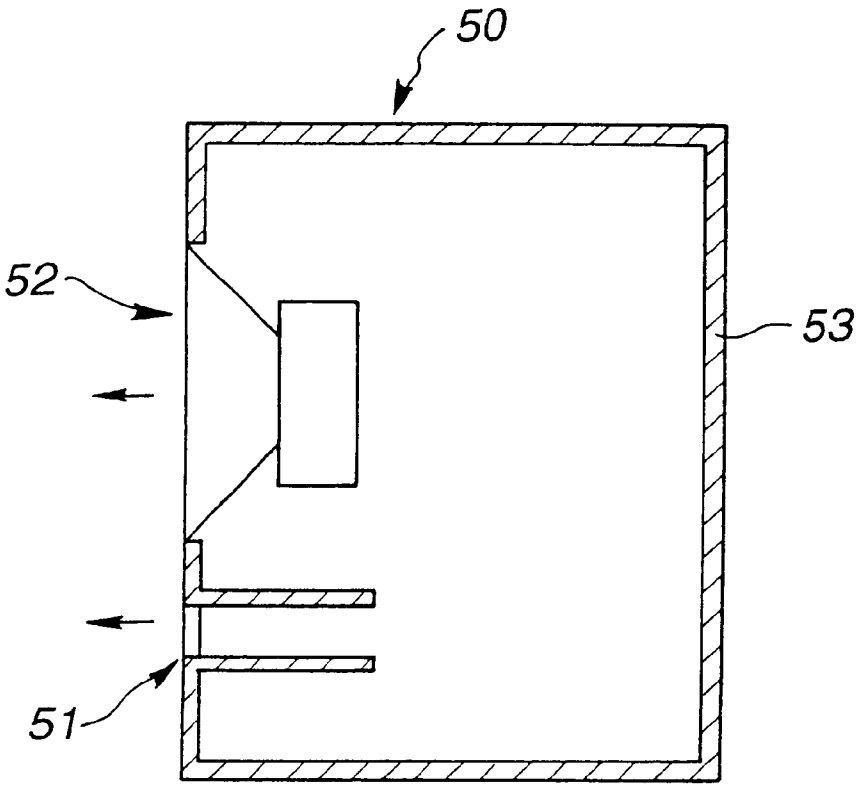

Referring to FIG. 22, a microphone device 30 according to the present invention includes a microphone unit 31, provided with a diaphragm 32, set into oscillations by the sound admitted from outside, a voice coil 33 coupled to the diaphragm 32 and with a magnetic circuit 34 made up of a microphone 34*a* and a yoke 34*b*. On the back side of the microphone unit 31 is mounted a tubular vibration-proofing member 35, formed of, for example, elastic rubber. Within the vibration-proofing member 35, there is provided an equalizer 35*a* for attenuating the vibrations radiated towards the back side of the diaphragm 32 when the diaphragm 32 of the microphone unit 31 is set into oscillations. On the rear end of the vibration-proofing member 35 is mounted a cap 37 adapted for closing the tubular vibration-proofing member 35. Within this cap 37 is mounted a tubular member 41 having an elliptical cross-section along both lateral sides facing each other. This tubular member 41 partitions the spacing in the cap 37 to define a sound duct 39 in the cap 37. This sound duct 39 has an increased opening area towards an opening 39*a*, on which are admitted the vibrations radiated to the back side of the diaphragm 32, and is progressively reduced in the opening area in a direction proceeding towards the opposite side opening 39*b*. The peripheral wall section of the cap 37 formed with the opposite side opening 39*b* is formed with a through-hole 38 for communication of the sound duct 39 with outside.

With the present microphone device 30, the vibrations radiated towards the back side of the diaphragm 32 are admitted into the sound duct 39 via the opening 39*a* so as to be transmitted into the sound duct 39 as indicated by arrows in FIG. 22. The vibrations are repeatedly reflected within the sound duct 39 so as to be attenuated and radiated via through-hole 38 to outside. Thus, with the present microphone device 30, the vibrations radiated from the back side of the microphone unit 31 are prohibited from again entering the microphone unit 31 to reduce the distortion in the mid to high ranges to improve the acoustic characteristics.

What is claimed is:

1. An electro-acoustic transducer comprising:

electro-acoustic transducing means for converting input electrical signals into sound;

a casing in which said electro-acoustic transducing means is arranged and for delimiting a back cavity toward a back surface of said electro-acoustic transducing means; and means for forming a sound duct having two opening ends wherein both opening ends of said sound duct communicate with said back cavity, are inside said casing, and do not communicate with an exterior of said casing and sound radiated from the back surface of said electro-acoustic transducing means is transmitted inside of said sound duct for attenuation thereof.

2. The electro-acoustic transducer according to claim 1 wherein said duct is progressively reduced in cross-sectional area in a direction from one of said two opening ends towards the other of said two opening ends.

3. The electro-acoustic transducer according to claim 1 wherein said sound duct is arranged so that one of said opening ends is lying toward an inside surface of a rear wall section of the casing and the other of the two opening ends is lying toward an inside surface of a front wall section of the casing.

4. The electro-acoustic transducer according to claim 1 wherein said sound duct is progressively reduced in cross-sectional area in a direction from one of said two opening ends towards the other of said two opening ends and a sound absorbing material is provided in the vicinity of one of said two opening ends for attenuating sound.

5. The electro-acoustic transducer according to claim 1 wherein said sound duct is progressively reduced in cross-sectional area in a direction from one of said two opening ends towards the other of said two opening ends and said sound duct is provided with sound absorbing material having an increasing density in the direction from the larger cross-sectional area towards the smaller cross-sectional area of the sound duct.

6. The electro-acoustic transducer according to claim 1 wherein said casing forms a hermetically sealed casing, and the sound radiated by said electro-acoustic transducer is radiated outwardly only from a front surface of said electro-acoustic transducing means.

7. The electro-acoustic transducer according to claim 1 wherein said casing forms a bass reflex casing further having a second sound duct as a bass reflex duct opening from inside to outside of the casing.

8. The electro-acoustic transducer according to claim 1 wherein said casing has an inner wall section towards the back surface of said electro-acoustic transducing means with a curved profile for guiding the sound radiated from the back surface of said electro-acoustic transducing means to at least one of the two opening ends of said sound duct.

9. The electro-acoustic transducer according to claim 1 wherein said casing has formed therein a through-hole traversing the casing for forming said sound duct inside said casing.

10. The electro-acoustic transducer according to claim 9 wherein said electro-acoustic transducing means comprises a first loudspeaker mounted in said casing and a second loudspeaker mounted in said through-hole.

11. The electro-acoustic transducer according to claim 9 further comprising an external electronic equipment arranged in said through-hole of said casing.

12. The electro-acoustic transducer according to claim 9 wherein an inner wall section of said casing towards the back surface of said electro-acoustic transducing means is hemispherically sealed and wherein said through-hole is offset relative to a center of said inner wall section.

13. An electro-acoustic transducer comprising:

electro-acoustic transducing means for converting input electrical signals into sound;

a casing in which said electro-acoustic transducing means is arranged and in which a back cavity is formed arranged towards a back surface of said electro-acoustic transducing means; and a plurality of sound ducts formed inside said casing, wherein each of said plurality of sound ducts has two opening ends, wherein both opening ends of each sound duct communicate with said back cavity, are inside said casing, and do not communicate with an exterior of said casings, and the sound radiated from the back surface of said electro-acoustic transducing means is attenuated by being transmitted into the inside of said sound duct.

14. An acoustic-electrical transducer comprising:

acoustic-electrical transducing means for converting an input sound into electrical signals;

a casing for delimiting a back cavity toward a back surface of said acoustic-electrical transducing means; and a sound duct having at least two opening ends wherein both of said opening ends communicate with said back cavity, are inside said casing, and do not communicate with an exterior of said casing, and wherein sound radiated from the rear side of said acoustic-electrical transducing means is transmitted into said sound duct for attenuation thereby.

* * * * *